US008752723B2

(12) United States Patent
Lucas et al.

(10) Patent No.: US 8,752,723 B2
(45) Date of Patent: Jun. 17, 2014

(54) WASTE DISPOSAL DEVICE HAVING TUBULAR FILM

(75) Inventors: Jan Willem Lucas, Koudekerk aan den Rijn (NL); Steven Joost Nijenhuis, Zoetermeer (NL); Robertus Dennis Nieuwveen, Leiden (NL)

(73) Assignee: Lencon Products B.V., Koudekerk aan den Rijn (NL)

( * ) Notice: Subject to any disclaimer, the term of this patent is extended or adjusted under 35 U.S.C. 154(b) by 0 days.

(21) Appl. No.: 13/994,534

(22) PCT Filed: Dec. 19, 2011

(86) PCT No.: PCT/NL2011/050861

§ 371 (c)(1), (2), (4) Date: Jul. 25, 2013

(87) PCT Pub. No.: WO2012/081985

PCT Pub. Date: Jun. 21, 2012

(65) Prior Publication Data

US 2013/0298506 A1 Nov. 14, 2013

(30) Foreign Application Priority Data

Dec. 17, 2010 (NL) ..... 1038459

(51) Int. Cl.

| | |
|---|---|
| ***B65D 25/18*** | (2006.01) |
| ***B65D 25/16*** | (2006.01) |
| ***B65B 7/12*** | (2006.01) |
| ***B65B 51/00*** | (2006.01) |

(52) U.S. Cl.

USPC ..... 220/495.07; 220/495.08; 220/908.1; 53/370; 53/567

(58) Field of Classification Search

USPC ..... 53/370, 472, 567, 574; 220/229, 220/495.03–495.11, 908–811

See application file for complete search history.

(56) References Cited

U.S. PATENT DOCUMENTS

| | | | | | |
|---|---|---|---|---|---|
| 2,411,430 | A | * | 11/1946 | Hodson | 220/23.87 |
| 3,927,786 | A | * | 12/1975 | Aboud | 220/4.01 |
| 4,254,602 | A | * | 3/1981 | Boynton | 53/390 |
| 4,427,110 | A | * | 1/1984 | Shaw, Jr. | 206/205 |
| D285,849 | S | * | 9/1986 | Hughes | D34/1 |
| 4,643,380 | A | * | 2/1987 | Copeland | 248/97 |
| 4,842,228 | A | * | 6/1989 | Kasper | 248/97 |
| 4,869,049 | A | * | 9/1989 | Richards et al. | 53/459 |
| 5,125,526 | A | * | 6/1992 | Sumanis | 220/263 |
| 5,213,228 | A | * | 5/1993 | Chang | 220/495.08 |
| 5,295,606 | A | * | 3/1994 | Karwoski | 220/4.01 |
| 5,328,028 | A | * | 7/1994 | Hale et al. | 206/366 |
| 5,358,138 | A | * | 10/1994 | Karwoski | 220/495.11 |

(Continued)

FOREIGN PATENT DOCUMENTS

| | | |
|---|---|---|
| EP | 0005660 A1 | 11/1979 |
| GB | 2389030 A | 12/2003 |

*Primary Examiner* — Anthony Stashick
*Assistant Examiner* — Ned A Walker
(74) *Attorney, Agent, or Firm* — Bozicevic, Field & Francis LLP; Bret E. Field

(57) ABSTRACT

The present invention relates to a device (1) for storing waste, which device (1) is adapted to receive a supply of tubular film (21) and comprises a chamber (15) for receiving waste deposited in the tubular film (21). The present invention also relates to a method for packaging waste in a tubular film (21) and storing the packaged waste in a chamber (15) of a device (1) provided with a cover (3).

12 Claims, 16 Drawing Sheets

(56) References Cited

U.S. PATENT DOCUMENTS

| | | | | |
|---|---|---|---|---|
| 5,385,259 | A * | 1/1995 | Bernstein et al. | 220/495.11 |
| 5,511,657 | A * | 4/1996 | Gnau et al. | 206/204 |
| 5,520,303 | A * | 5/1996 | Bernstein et al. | 220/495.08 |
| 5,590,512 | A * | 1/1997 | Richards et al. | 53/567 |
| 5,655,680 | A * | 8/1997 | Asbach et al. | 220/495.11 |
| 5,687,839 | A * | 11/1997 | Gnau et al. | 206/204 |
| 5,813,200 | A * | 9/1998 | Jacoby et al. | 53/567 |
| 6,170,240 | B1 * | 1/2001 | Jacoby et al. | 53/567 |
| 6,253,949 | B1 * | 7/2001 | Dickson | 220/495.04 |
| 6,370,847 | B1 * | 4/2002 | Jensen et al. | 53/459 |
| 6,508,377 | B1 * | 1/2003 | Griswold et al. | 220/495.06 |
| 6,516,588 | B2 * | 2/2003 | Jensen et al. | 53/459 |
| 6,612,099 | B2 * | 9/2003 | Stravitz | 53/526 |
| 6,626,316 | B2 * | 9/2003 | Yang | 220/263 |
| 6,644,493 | B1 * | 11/2003 | Walton et al. | 220/603 |
| 6,719,194 | B2 * | 4/2004 | Richards | 232/43.1 |
| 6,804,930 | B2 * | 10/2004 | Stravitz | 53/211 |
| 6,817,164 | B2 * | 11/2004 | Mauffette et al. | 53/576 |
| 6,851,251 | B2 * | 2/2005 | Stravitz | 53/567 |
| 6,925,781 | B1 * | 8/2005 | Knuth et al. | 53/459 |
| 6,993,891 | B2 * | 2/2006 | Richardson et al. | 53/567 |
| 6,994,247 | B2 * | 2/2006 | Richards | 232/43.1 |
| 7,114,314 | B2 * | 10/2006 | Stravitz | 53/567 |
| 7,114,534 | B2 * | 10/2006 | Chomik et al. | 141/114 |
| 7,146,785 | B2 * | 12/2006 | Stravitz | 53/567 |
| 7,178,314 | B2 * | 2/2007 | Chomik et al. | 53/459 |
| 7,316,100 | B2 * | 1/2008 | Stravitz et al. | 53/211 |
| 7,350,663 | B2 * | 4/2008 | Chomik et al. | 220/264 |
| 7,395,646 | B2 * | 7/2008 | Salman et al. | 53/567 |
| 7,406,814 | B2 * | 8/2008 | Morand | 53/567 |
| 7,434,377 | B2 * | 10/2008 | Stravitz et al. | 53/567 |
| 7,503,152 | B2 * | 3/2009 | Stravitz et al. | 53/211 |
| 7,503,159 | B2 * | 3/2009 | Stravitz et al. | 53/567 |
| 7,594,376 | B2 * | 9/2009 | Chomik | 53/567 |
| 7,617,659 | B2 * | 11/2009 | Stravitz et al. | 53/567 |
| 7,694,493 | B2 * | 4/2010 | Stravitz et al. | 53/370 |
| 7,696,711 | B2 * | 4/2010 | Pollack et al. | 318/466 |
| 7,707,808 | B2 * | 5/2010 | Chomik | 53/576 |
| 7,708,188 | B2 * | 5/2010 | Stravitz et al. | 232/43.2 |
| 7,712,285 | B2 * | 5/2010 | Stravitz et al. | 53/77 |
| D619,905 | S * | 7/2010 | Dunn et al. | D9/703 |
| 7,757,467 | B2 * | 7/2010 | Chomik et al. | 53/567 |
| 7,931,150 | B2 * | 4/2011 | Morand | 206/554 |
| D639,002 | S * | 5/2011 | Dunn et al. | D32/37 |
| D639,003 | S * | 5/2011 | Dunn et al. | D32/37 |
| D639,004 | S * | 5/2011 | Dunn et al. | D32/37 |
| 7,958,704 | B2 * | 6/2011 | Stravitz et al. | 53/567 |
| 7,963,414 | B1 * | 6/2011 | Stravitz | 220/264 |
| 7,988,008 | B2 * | 8/2011 | Banik et al. | 220/254.3 |
| 7,992,742 | B1 * | 8/2011 | Kim | 220/495.08 |
| 8,091,325 | B2 * | 1/2012 | Stravitz et al. | 53/567 |
| 8,127,519 | B2 * | 3/2012 | Stravitz | 53/469 |
| 8,215,089 | B2 * | 7/2012 | Stravitz | 53/567 |
| 8,235,237 | B1 * | 8/2012 | Stravitz | 220/264 |
| 8,266,870 | B1 * | 9/2012 | Stravitz | 53/370 |
| 8,266,871 | B1 * | 9/2012 | Stravitz | 53/370 |
| 8,333,293 | B2 * | 12/2012 | Morand | 220/264 |
| 8,393,489 | B1 * | 3/2013 | Stravitz | 220/264 |
| 8,567,157 | B2 * | 10/2013 | Dunn et al. | 53/370 |
| 8,613,371 | B2 * | 12/2013 | Rousso et al. | 220/495.07 |
| 2002/0066261 | A1 * | 6/2002 | Richards | 53/574 |
| 2002/0158068 | A1 * | 10/2002 | Panek, Jr. | 220/23.87 |
| 2005/0044819 | A1 * | 3/2005 | Chomik et al. | 53/459 |
| 2005/0217214 | A1 | 10/2005 | Richardson et al. | |
| 2006/0157548 | A1 * | 7/2006 | Bastiani | 232/43.2 |
| 2007/0125792 | A1 | 6/2007 | Pollack et al. | |

* cited by examiner

WASTE DISPOSAL DEVICE HAVING TUBULAR FILM

The present invention relates to a device and method for the disposal of waste, wherein the waste is packed in a tubular film and stored in a chamber of a device provided with a cover.

Such a device and method are known in the art. It is particularly important in kitchens of for instance hospitals, restaurants and the like that the waste is isolated in hygienic manner before it is disposed of, in order to prevent vermin such as insects (flies, fruit flies and so on) being attracted by food remnants. It is also known to package female hygiene products (sanitary towels, tampons) and nappies in public toilets by means of such a method, wherein it is important that unpleasant odours cannot escape.

Particularly described in the art are methods and devices wherein the waste product is isolated by rotating the waste introduced into the tubular film, whereby a constriction is formed above the waste in the tubular film. Methods and devices are also known wherein individual packages with waste are formed by means of thermally sealing jaws.

Although the known methods and devices per se provide an effective solution to the above stated problems, the devices required for performing the method are relatively complicated and expensive. It will be evident that for the stated purpose, the disposal of waste, this is undesirable. A complicated device is in principle also more susceptible to malfunction. It is precisely for the problem to be solved that this is undesirable, since precisely the unhygienic situations which must be avoided can then occur.

The present invention has for its object, among others, to provide a device which takes a relatively simple form, efficiently blocks the access to the waste, does not allow possible odour to escape from the tubular film and is relatively inexpensive.

The invention provides for this purpose a device which is adapted to receive a supply of tubular film and comprises a chamber for receiving waste deposited in the tubular film. The device according to the invention further comprises:

- a passage adapted to guide the tubular film from the supply to the chamber;
- a cover which in an open state gives access to the passage for the purpose of placing waste in the tubular film guided by the passage, and which in a closed state closes the passage;
- a first and a second closing element on a side of the passage remote from the cover, i.e. between the passage and the chamber, between which closing elements the tubular film can be positioned;
- a closing and transport mechanism adapted to carry the closing elements in a closed state from a first closing position away from the passage in the direction of the chamber to a second closing position, and to carry the closing elements in an open state from the second closing position back to the first closing position, wherein back in the first closing position the closing elements are back in the closed state, wherein in the closed state the closing elements press together the tubular film positioned therebetween to form a sealing closure, and wherein in the open state the closing elements are situated at a distance from each other so that the sealing closure is released and the closing elements can be displaced along the tubular film and waste deposited therein. The device according to the invention is further adapted to set the closing and transport mechanism into operation once the cover has been moved from the opened state to the closed state thereof.

The device according to the invention makes it possible to prevent the user being confronted with waste already stored by the device, both in terms of possible odour of the already stored waste and in terms of the appearance thereof, without the tubular film being closed after each insertion of waste by rotating the tubular film so that a constriction is formed in the tubular film above the inserted waste and without the tubular film being permanently closed by means of a heat sealing process after each insertion of waste.

Although the release of the sealing closure of the tubular film, when the closing elements in an open state are carried from the second closing position back to the first closing position, results in an open passage to the waste which has already been placed in the tubular film on a previous occasion (and which has possibly begun to smell), the condition that the cover is closed before the closing and transport mechanism is set into operation avoids unpleasant odours being able to escape from the tubular film and the user being confronted with the waste already placed in the device. After passage of the waste the seal of the tubular film between the closing elements is re-established, whereby escape of odour and/or ingress of insects is avoided. Due to the displacement of the closing elements in the closed state from the first closing position to the second closing position the tubular film is pulled in the direction of the chamber and out of the supply. When during a subsequent use the cover is opened in order to insert fresh waste, the user is confronted with new film which is closed on the side of the chamber, so that the subsequent user is not confronted with the waste previously placed in the device.

Owing to the absence of complicated mechanisms for closing the tubular film each time by means of constrictions or heat seals the device according to the invention can be given a relatively simple, inexpensive and operationally reliable form.

In a favourable embodiment of the device according to the invention the closing and transport mechanism comprises:

- at least one electric motor and a transmission co-acting therewith which are adapted to drive the closing and transport mechanism; and
- a control which is connected to the at least one electric motor and adapted to control the at least one electric motor, wherein the control is also adapted to determine that the cover has been moved from the opened state to the closed state thereof and, after determining that the cover has been moved from the opened state to the closed state thereof, to activate the at least one electric motor.

The application of electric motors and a control therefor, for instance powered by means of a battery, enable a particularly simple, reliable embodiment of the closing and transport mechanism and moreover make it possible that the use of the device is exceptionally simple for a user and costs little difficulty. Although electric motors are particularly preferred, other types of motor could also be applied, such as hydraulic or pneumatic motors.

In a favourable embodiment hereof the closing and transport mechanism comprises:

- a frame arranged translatably in the device by means of a transport guide so that the frame can be translated along the frame guide from a first frame position away from the passage in the direction of the chamber into a second frame position, and can be translated from the second frame position away from the chamber in the direction of the passage into the first frame position;

wherein the closing elements are arranged on the frame;

at least one of the closing elements is arranged on the frame for translation relative to the frame by means of a closing guide so that, by means of a translation along the closing guide, from the open state the closing elements can be moved toward each other in order to carry the closing elements into the closed state and from the closed state can be moved away from each other in order to carry the closing elements into the open state.

These measures enable an implementation of the closing and transport mechanism with simple translations of the moving components, so that the embodiment of the closing and transport mechanism can be given a simple and reliable form. Translations can moreover be realized with simple combinations of electric motor and transmission co-acting therewith, such as for instance a combination of a simple electric motor with rotating output shaft and a gear rack transmission, or a combination of a simple electric motor with rotating output shaft and a screw jack transmission.

In a further favourable embodiment hereof the closing and transport mechanism comprises:

a coupling guide which defines a path along which the relevant closing element which is arranged translatably on the frame by means of the closing guide is guided during the translation of the frame along the frame guide from the first frame position away from the passage in the direction of the chamber into a second frame position, and from the second frame position away from the chamber in the direction of the passage into the first frame position, so that the translation of the relevant closing element along the closing guide and the translation of the frame along the frame guide are coupled; wherein an electric motor and a transmission co-acting therewith are adapted to translate the frame along the frame guide;

the control is adapted to control the electric motor upon activation thereof such that the frame is translated along the frame guide from the first frame position away from the passage in the direction of the chamber into a second frame position, and is subsequently translated from the second frame position away from the chamber in the direction of the passage into the first frame position; and the coupling guide is adapted such that, during translation of the frame by means of the electric motor, the closing elements in the closed state are carried from the first closing position away from the passage in the direction of the chamber to a second closing position, and from the second closing position the closing elements are carried in an open state back to the first closing position, wherein back in the first closing position the closing elements are back in the closed state.

These measures enable implementation with a single electric motor and a control of particularly simple form, this contributing toward reduction in costs and increasing the reliability of the device.

An alternative possibility however is also the use of separate motors for the translation of the frame and the translation of the closing element translatable relative to the frame. In such an alternative embodiment the closing and transport mechanism comprises a first electric motor and a second electric motor, wherein the first electric motor and a transmission co-acting therewith are adapted to translate the frame along the transport guide;

the second electric motor and a transmission co-acting therewith are adapted to translate the relevant closing element along the closing guide; and the control is adapted to control the first electric motor and the second electric motor such that the closing elements in a closed state are carried from a first closing position away from the passage in the direction of the chamber to a second closing position and the closing elements in an open state are carried from the second closing position back to the first closing position, wherein back in the first closing position the closing elements are back in the closed state.

These measures enable the use of electric motors of relatively light form and, moreover, a device of simple form.

In a further favourable embodiment of the device according to the invention as described above with a closing and transport mechanism provided with a number of electric motors and a control therefor, the device comprises:

a sensor which is connected to the control and with which the control can determine that a user wishes to use the device;

an electric motor connected to the control and transmission co-acting therewith with which the cover can be carried from the closed state to the open state and from the open state to the closed state;

wherein the control is adapted, after determining that a user wishes to use the device, to control the electric motor of the cover such that the cover is carried from the closed state to the open state and, after a determined period of time or after determining that the user has placed waste in tubular film, to control the electric motor of the cover such that the cover is carried from the open state to the closed state, and to subsequently activate the at least one electric motor of the closing and transport mechanism.

These measures make it possible that the user need only indicate that he/she wishes to use the device. The user need not open or close the cover him/herself. These measures moreover make it simple for the control to determine that the cover has been carried from the open state to the closed state. The sensor can be a push-button, but for instance also a sensor of the presence type, i.e. a sensor which need not be touched in order to detect the presence of for instance the hand of the user. When the latter type of sensor is applied, it is possible for the user to hold for instance only his/her hand by the sensor in order to activate the device, and he/she need not therefore touch the device. This latter has particular advantages in respect of hygiene.

In a further favourable embodiment of the device according to the invention as described above with a closing and transport mechanism provided with a number of electric motors and a control therefor, the device comprises a sensor which is connected to the control and using which the control can determine whether the cover is in the opened state or the closed state.

This measure enables an embodiment wherein the user him/herself opens and closes the cover, this contributing toward the simplicity of the device. However, in combination with an automatic opening and closing of the cover as described above, this measure also has the advantage that it is possible for the control to determine more accurately that the cover is closed.

In a further favourable embodiment of the device according to the invention as described above with a closing and transport mechanism provided with a number of electric motors and a control therefor, the device comprises between the closing elements and the cover a sensor connected to the control for detecting the presence of waste in the passage, and the control is adapted to activate the at least one electric motor of the closing and transport mechanism once the presence of waste in the passage has been detected.

These measures make it possible to avoid the closing and transport mechanism being set into operation without waste having been placed in the tubular film guided by the passage. This has the advantage of avoiding wastage of the supply of tubular film.

In a favourable embodiment hereof the sensor for detecting the presence of waste in the passage is an infrared sensor.

This measure makes it possible for the tubular film to be of a material permeable to infrared radiation but not to radiation in the visible spectrum, such as white PE film, so that the sensor can detect whether waste is present in the tubular film, while the person taking the tubular film and the waste stored therein out of the device for processing purposes cannot see the waste and is not therefore confronted therewith.

In addition to a device according to the invention as described above with a closing and transport mechanism provided with a number of electric motors and a control therefor, it is alternatively possible to embody the device without electric motors.

In such an alternative embodiment according to the invention the closing and transport mechanism comprises a frame arranged translatably in the device by means of transport guide so that the frame can be translated along the frame guide from a first frame position away from the passage in the direction of the chamber into a second frame position, and can be translated from the second frame position away from the chamber in the direction of the passage into the first frame position; wherein the closing elements are arranged on the frame;

at least one of the closing elements is arranged on the frame for translation relative to the frame by means of a closing guide so that, by means of a translation along the closing guide, from the open state the closing elements can be moved toward each other in order to carry the closing elements into the closed state and from the closed state can be moved away from each other in order to carry the closing elements into the open state; and the closing and transport mechanism comprises a coupling guide which defines a path along which the relevant closing element which is arranged translatably on the frame by means of the closing guide is guided during the translation of the frame along the frame guide from the first frame position away from the passage in the direction of the chamber into a second frame position, and from the second frame position away from the chamber in the direction of the passage into the first frame position, so that the translation of the relevant closing element along the closing guide and the translation of the frame along the frame guide are coupled.

In addition, this alternative embodiment comprises an operating element which can be displaced by a user from a first operating position to a second operating position, wherein the operating element and the cover are connected by means of a coupling mechanism so that during the displacement of the operating element from the first operating position to the second operating position the cover is carried from the closed state to the opened state, and during the displacement of the operating element from the second operating position to the first operating position the cover is carried from the opened state to the closed state. In this alternative embodiment the operating element and the closing and transport mechanism are also coupled by means of an energy storage mechanism, wherein the energy storage mechanism comprises:

a generator which is adapted during displacement of the operating element to generate energy from this displacement and to store this energy; and a motor and transmission co-acting therewith which are adapted to use the stored energy to translate the frame from the first frame position to the second frame position and subsequently from the second frame position to the first frame position. The energy storage mechanism is adapted here to activate the motor after the operating element has been displaced from the second operating position to the first operating position.

These measures enable operation of the device according to the invention by the user without the use of electric motors. This has for instance the advantage that a power supply can be dispensed with.

The operating element can be an operating element which can be operated by hand as well as by foot, but preferably comprises a foot pedal. This latter has the advantage that the user need not touch the device with the hands in order to set the device into operation, this contributing toward hygiene.

In a favourable embodiment of this alternative embodiment of the device according to the invention the generator comprises a spring system coupled by means of a transmission to the operating element so that a displacement of the operating element is stored in the form of spring energy, and the motor is adapted to convert the stored spring energy to a movement which can be transmitted by means of the transmission co-acting with the motor to the frame in order to translate the frame along the frame guide.

These measures enable a relatively simple storage and release of energy.

In a favourable embodiment of the device according to the invention both closing elements are translated relative to the frame when the closing elements are carried from the open state to the closed state, and when the closing elements are carried from the closed state to the open state.

The tubular film can in this way be guided symmetrically through the passage, this contributing toward reliable operation.

In a further favourable embodiment of the device according to the invention at least one of the closing elements comprises resilient material for pressing together the tubular film in sealing manner.

This measure makes it possible to avoid damage to the tubular film. The resilient material is preferably chosen from rubber or plastic. Both closing elements preferably comprise resilient material.

In a further favourable embodiment of the device according to the invention at least one of the closing elements comprises a roller which can be rotated about an eccentric rotation axis and which is biased in a starting position by means of a spring, wherein the roller is arranged such that, when the roller is pressed against the relevant closing element in order to carry the closing elements into the closed state, the roller is pressed out of the starting position and rotated about the rotation axis counter to the action of the spring, and wherein the roller is arranged such that the spring biases the roller in a direction opposite to the direction in which the closing elements are moved from the first closing position to the second closing position.

These measures enable an exceptionally good clamping of the tubular film between the closing elements so that slippage of the tubular film between the closing elements is avoided when the closing elements are carried from the first closing position away from the passage in the direction of the chamber to a second closing position in the closed state.

The present invention also relates to a method for packaging waste in a tubular film and storing the packaged waste in a chamber of a device provided with a cover, preferably a device according to the invention as described above, the method comprising the steps of:

guiding the tubular film from a supply of tubular film to the chamber via a passage to be closed by means of the cover;

pressing together the tubular film on a side of the passage remote from the cover by means of a first and a second closing element to form a sealing closure;

receiving the waste for packaging in the passage;

determining that the cover has been carried from an opened state, in which waste can be placed in the passage, to a closed state in which the cover closes the passage;

transporting the waste to the chamber after determining that the cover has been carried to the closed state, wherein transport of the waste to the chamber comprises the steps of:

transporting the waste together with a portion of the tubular film by displacing the closing elements in the direction of the chamber while the tubular film is pressed together between the closing elements;

moving the closing elements a distance apart so that the sealing closure is released and the closing elements can be displaced along the tubular film and waste deposited therein;

displacing the closing elements in the direction of the passage along the portion of the tubular film and the waste placed therein; and pressing together the tubular film above the portion of the tubular film and the waste placed therein by carrying the closing elements toward each other again to once again form a sealing closure.

This method according to the invention has the advantages as described above with reference to the device according to the invention.

A favourable embodiment of the method according to the invention also comprises the step of carrying the cover from the opened state to the closed state prior to the step of determining that the cover has been carried from the opened state to the closed state.

Active closure of the cover makes it possible to ensure that the user is not confronted with the content of the chamber. In a further favourable embodiment the method also comprises the step of carrying the cover from the closed state to the opened state for the purpose of receiving the waste for packaging after determining that a user wishes to use the device. This makes it possible that a user need not touch the cover at all.

The present invention will be further elucidated hereinbelow on the basis of exemplary embodiments, which are shown schematically in the accompanying drawing. These are non-limitative exemplary embodiments.

Figure 1:
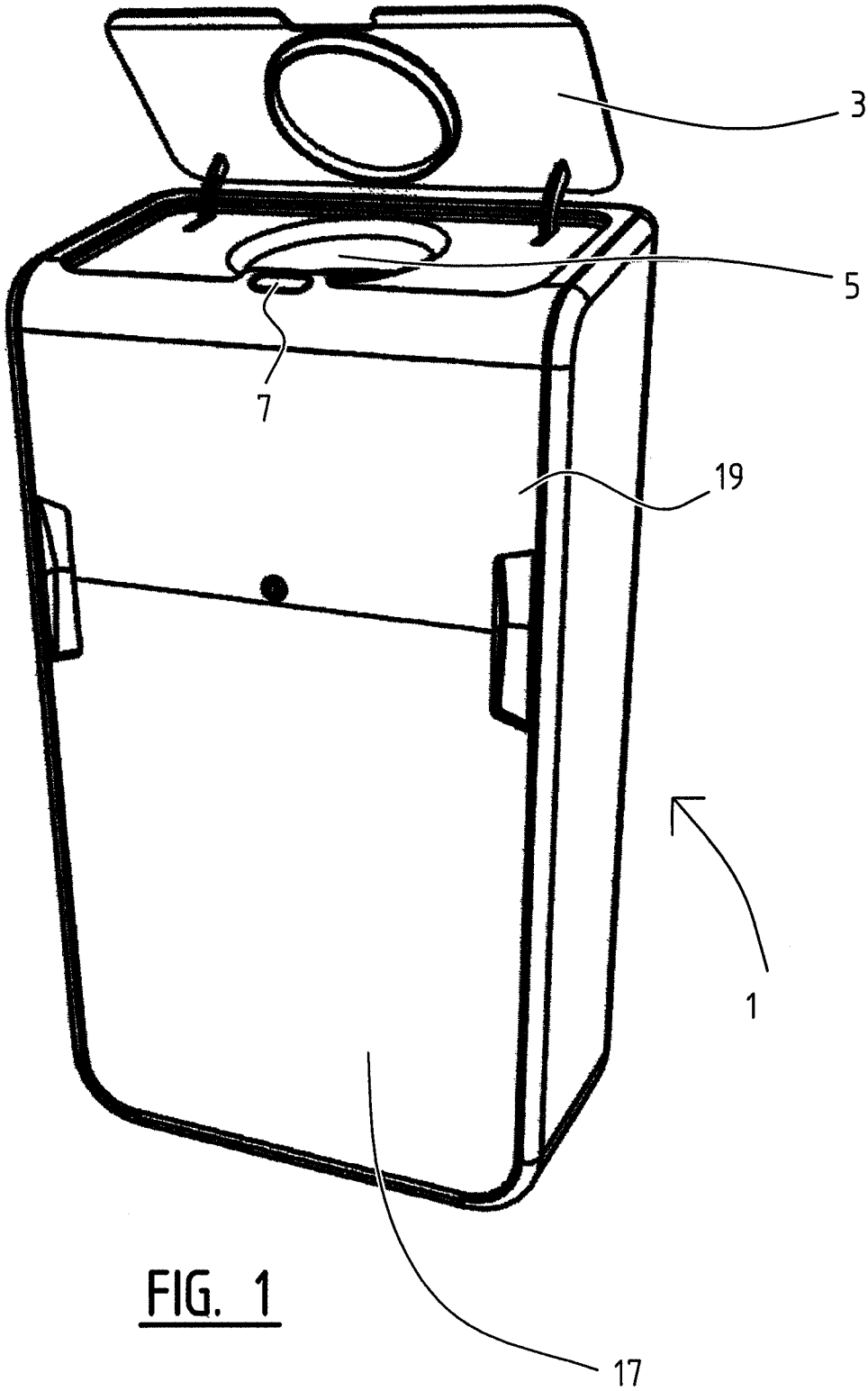
FIG. 1 is a perspective view of a first exemplary embodiment of a device according to the invention.
Figure 2:
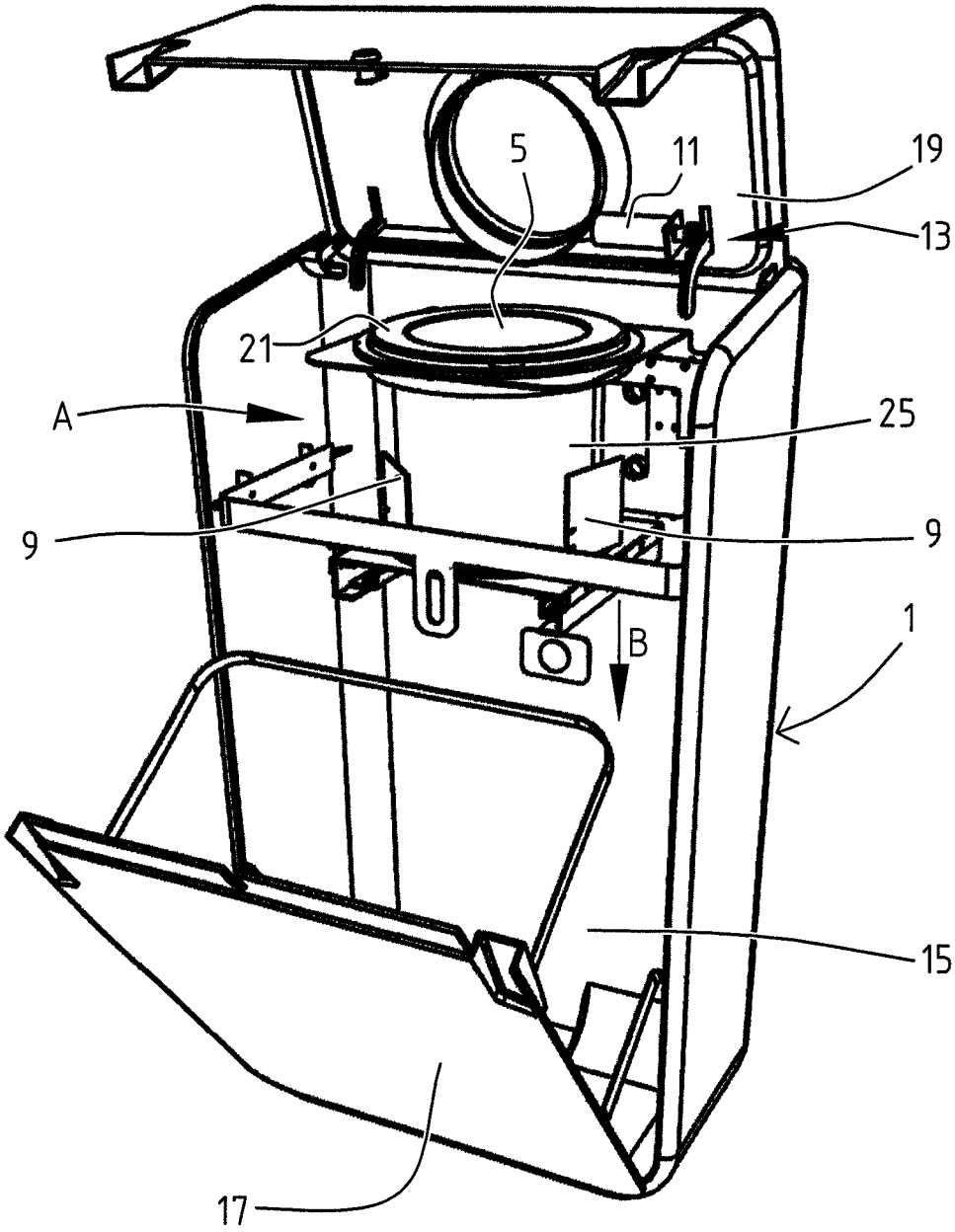
FIG. 2 shows the device of FIG. 1 in an opened state.
Figure 3:
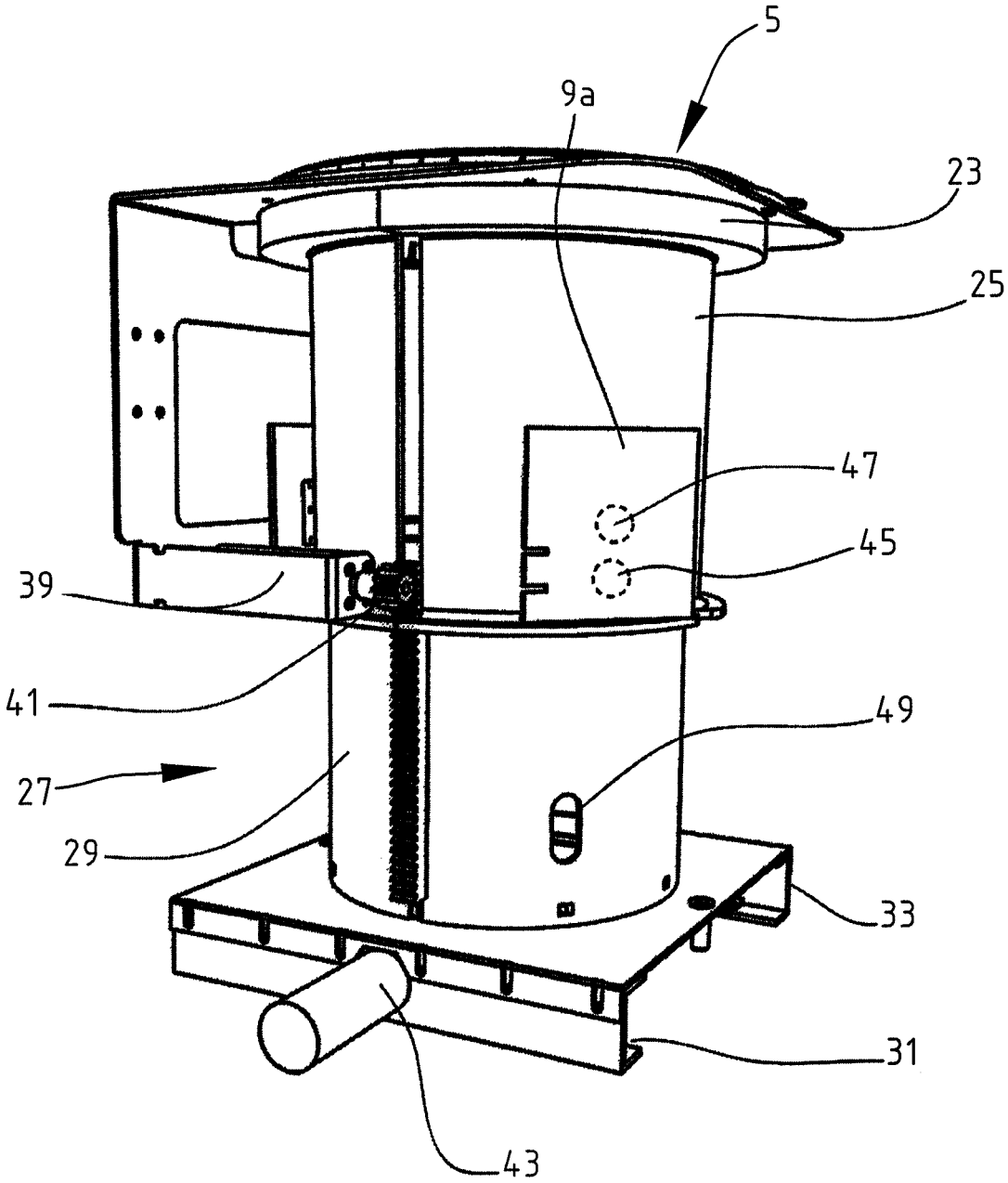
FIG. 3 shows a detail of the device of FIG. 2.
Figure 5:
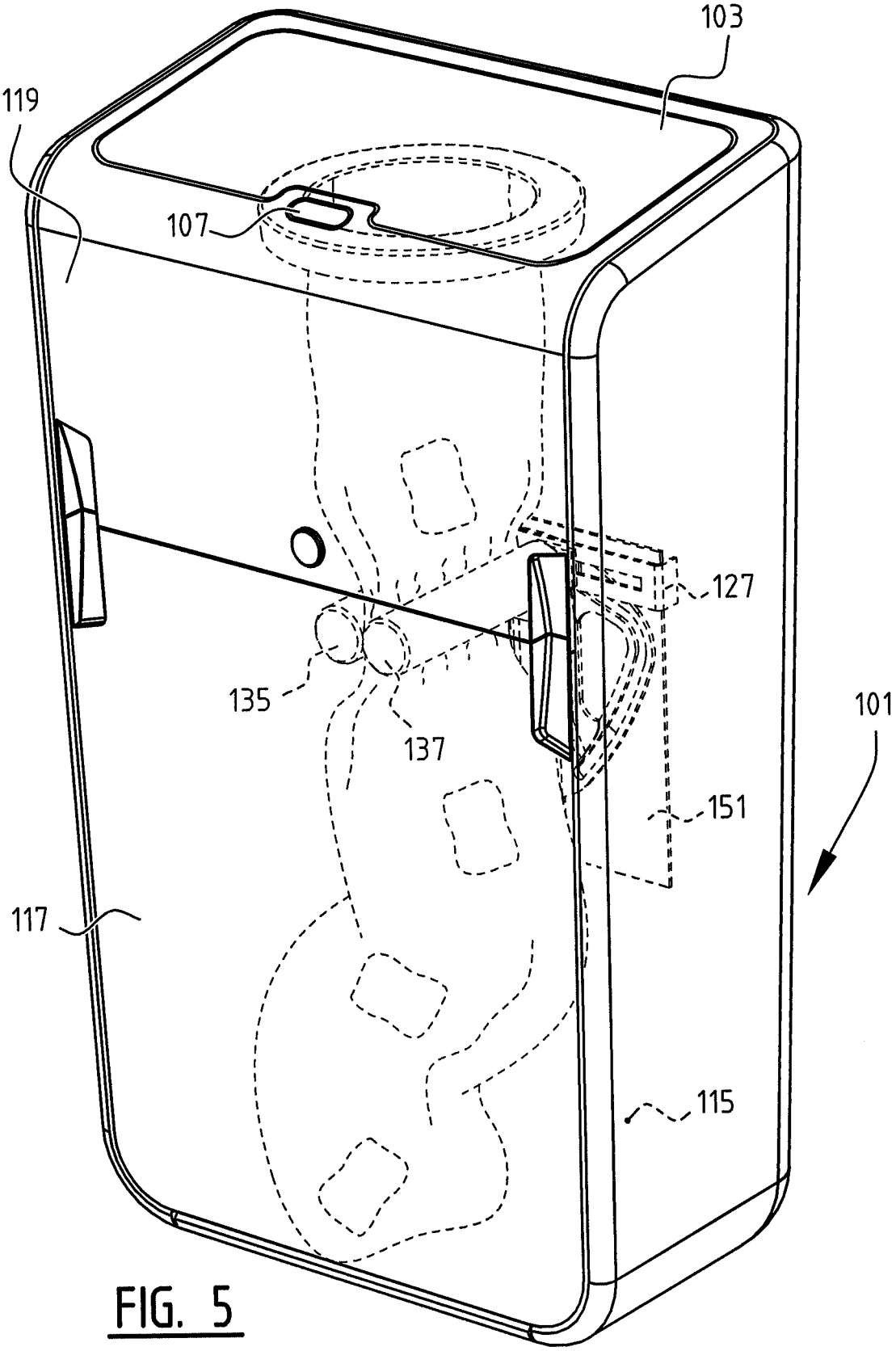
Figure 7:
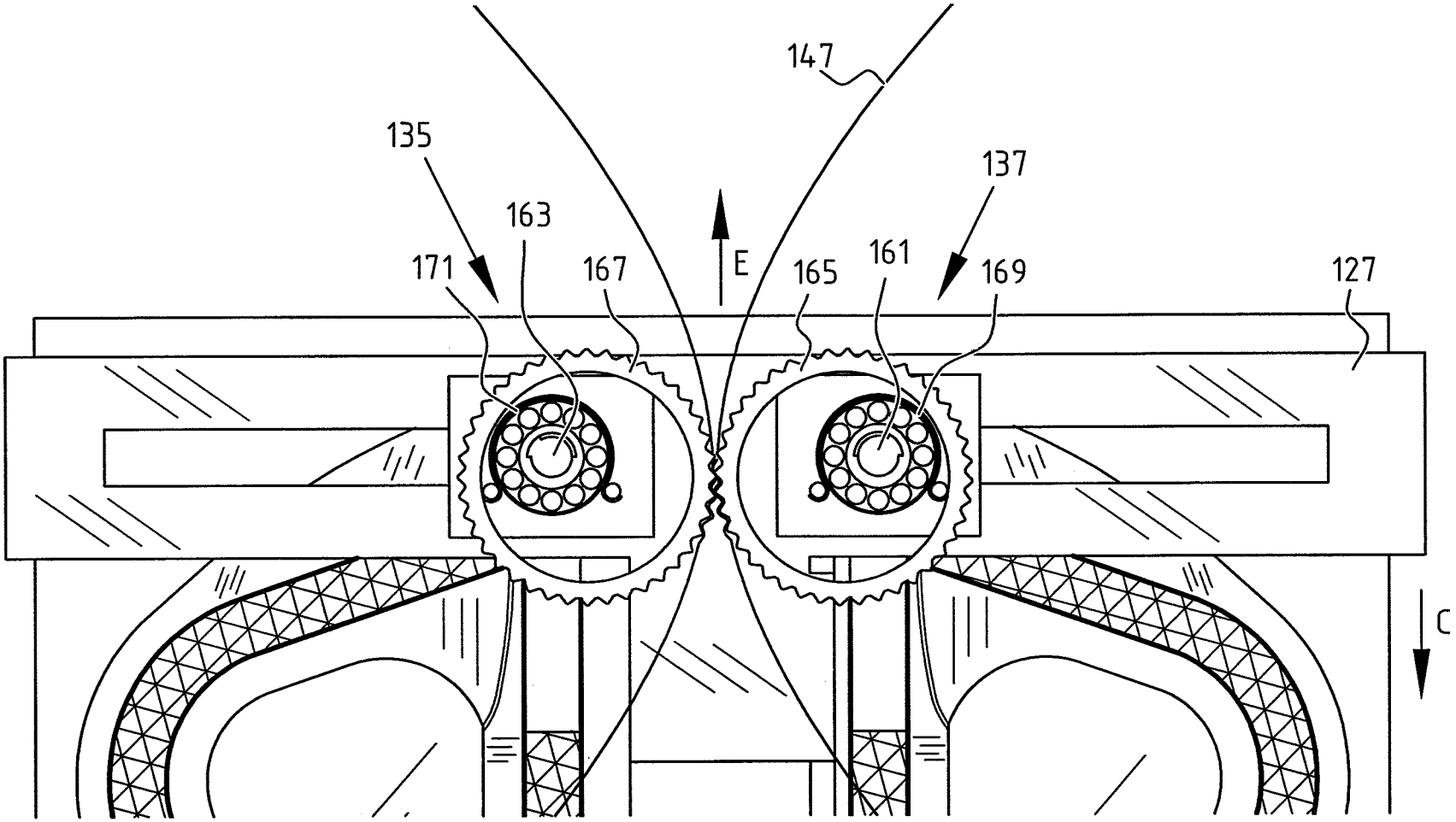
Figure 8:
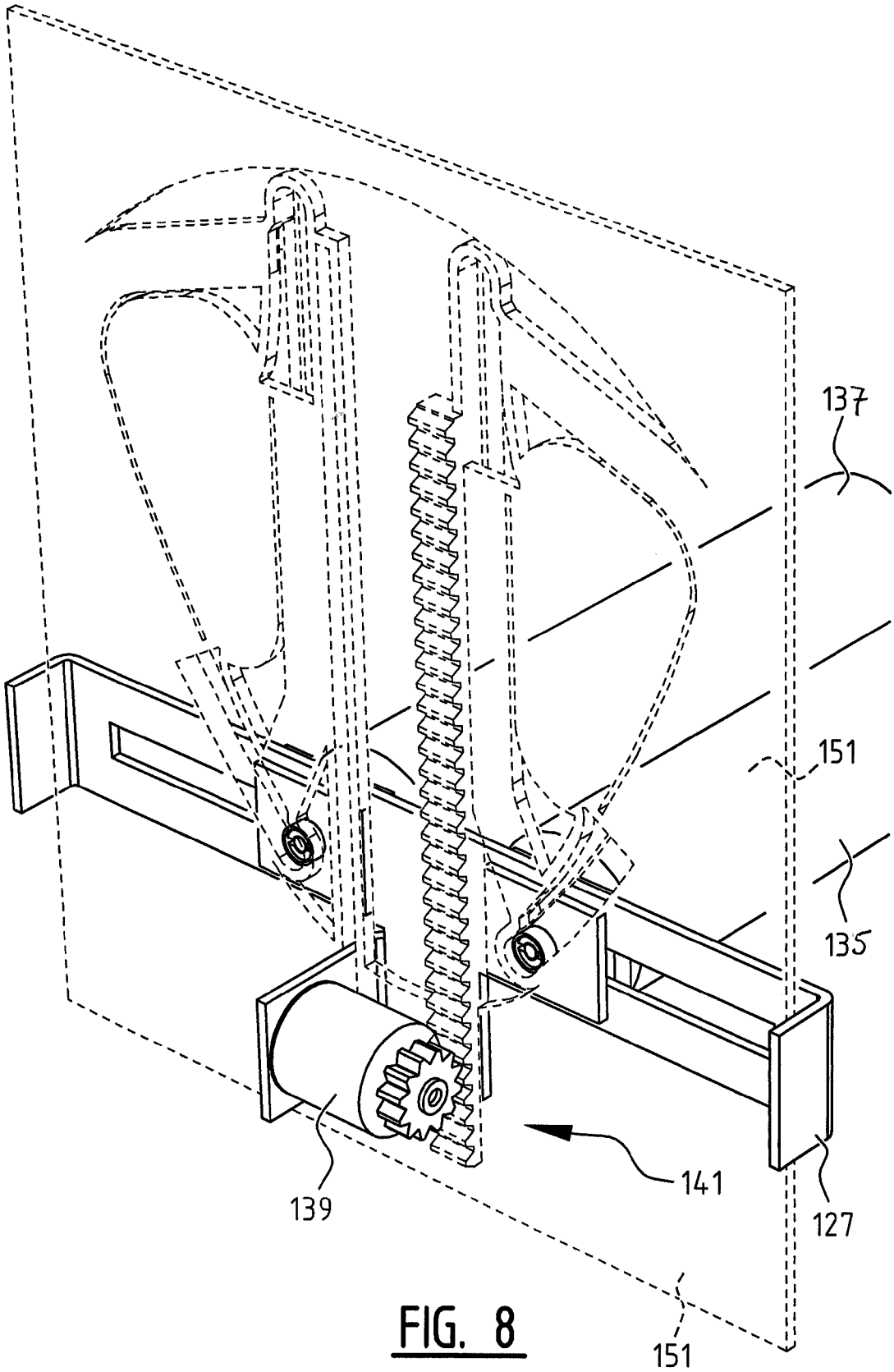
Figure 9:
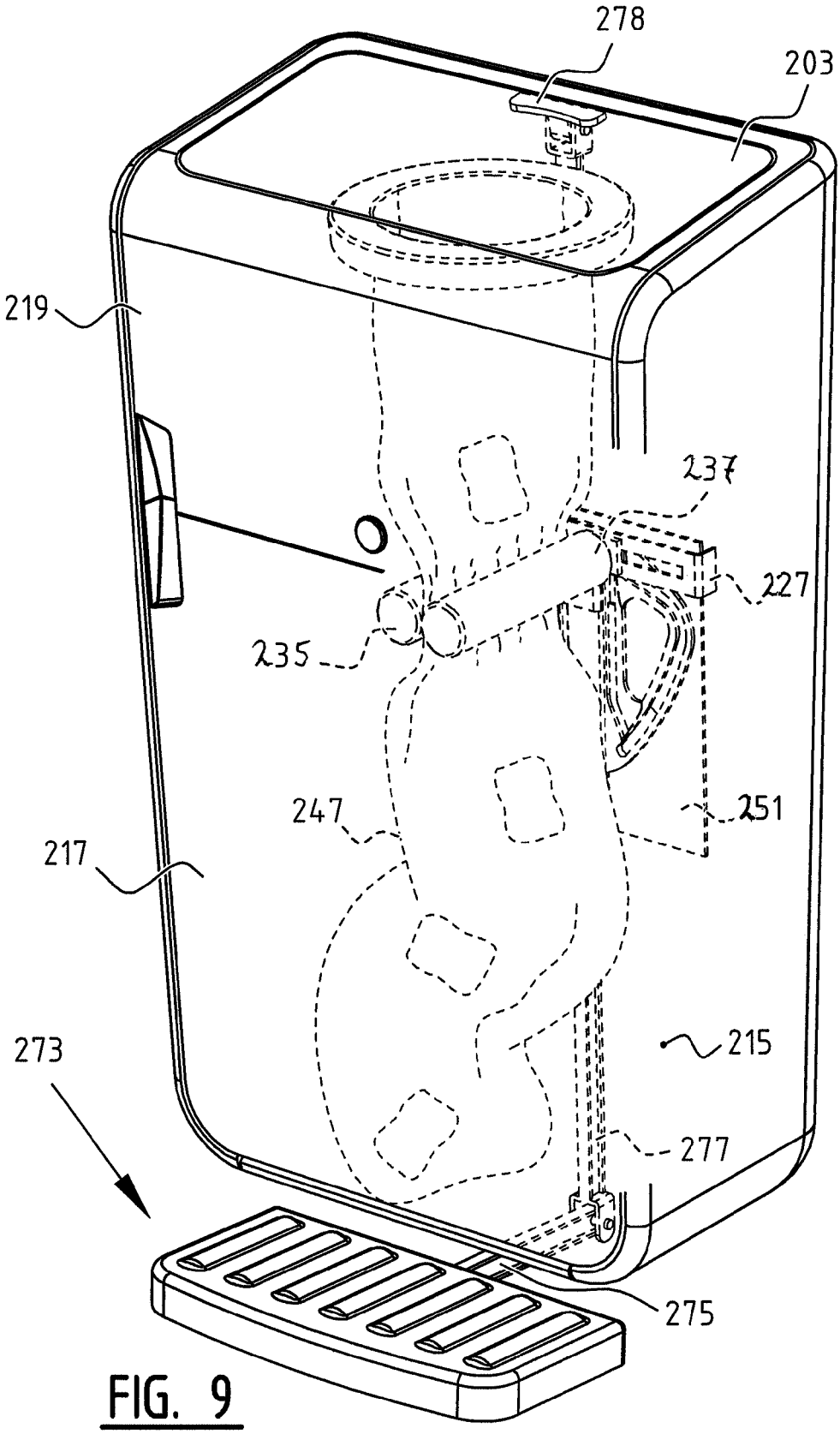
Figure 10:
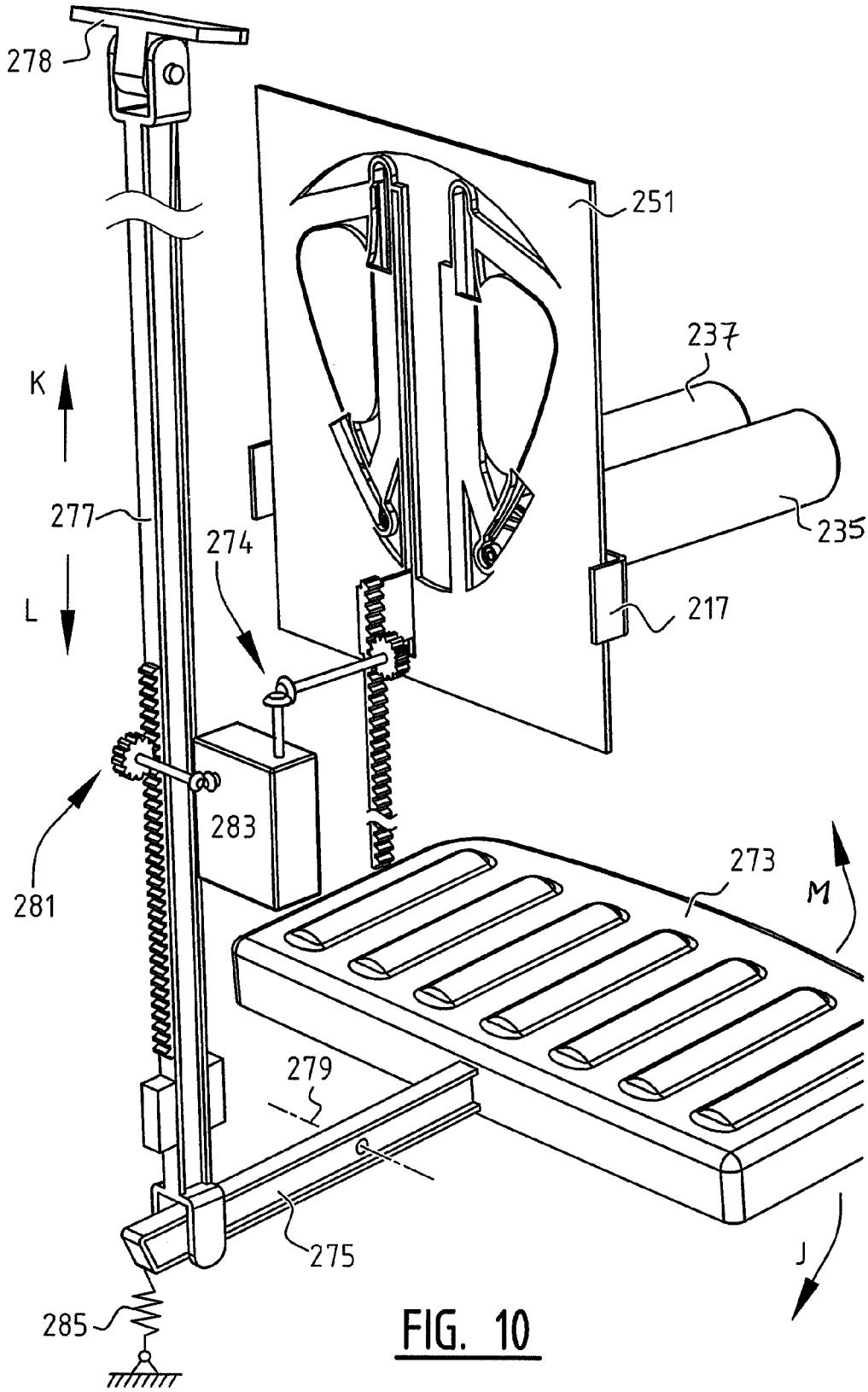

FIG. 4*a*-4*e* show in stepwise manner the operation of the device of FIGS. 1, 2 and 3;

FIG. 5 is a partially cut-away perspective view of a second exemplary embodiment of a device according to invention;

FIG. 6*a*-6*e* show in stepwise manner the operation of the device of FIG. 5;

FIG. 7 is a side view of a detail of the device of FIG. 5;

FIG. 8 is a perspective view of a detail of the device of FIG. 5;

FIG. 9 is a perspective view of a third exemplary embodiment of a device according to the invention;

FIG. 10 shows a schematic view of a detail of the device of FIG. 9.

FIGS. 1 and 2 show a device 1 according to invention for hygienic disposal of waste, such as sanitary towels. In FIG. 1 device 1 is shown during use thereof. In FIG. 2 device 1 has been opened for the purpose of removing from device 1 waste placed therein, so that the interior of device 1 is visible.

Device 1 has a cover 3 shown in FIG. 1 in opened state, whereby a passage 5 is visible in which a user can place waste. Cover 3 is opened after a user has held his/her hand close to sensor 7, after which a control arranged on printed circuit boards 9 in device 1 has activated an electric motor 11 which, by means of a gear rack transmission 13, has moved cover 3 from a closed state to the open state shown in FIG. 1.

FIG. 2 shows that device 1 has a chamber 15 which is closable with a first closing hatch 17 and a second closing hatch 19, which are shown in the opened state in FIG. 2. Via the opened closing hatches 17, 19 a supply of tubular film can be arranged on a cartridge 21 in the device and, after some period of use, tubular film (not shown here) containing waste can be taken out of device 1. When taken into use the tubular film will be closed at an end thereof, for instance with a seal or using a knot. When the tubular film is taken out of device 1, the other outer end will likewise be closed, such as with a knot. All the waste is located inside the tubular film, and whoever performs the operations does not come into contact with the waste. When non-transparent tubular film is used, the content remains wholly concealed from view for this person.

FIG. 3 shows in detail a portion A of the device.

FIG. 3 shows that device 1 has a cartridge chamber 23 into which a cartridge 21 known in the art with a supply of tubular film can be placed. This tubular film is guided via passage 5 to chamber 15 of device 1.

In the embodiment shown here passage 5 is formed by a cylindrical outer wall 25 which serves as frame guide for a frame 27. Frame 27 is shown as a cylindrical inner wall 29 provided with closing guides 31, 33 at an end remote from the cylindrical outer wall 25. Arranged in the closing guides are closing elements 35, 37, which are further shown in FIG. 4.

Frame 27 can be translated along cylindrical outer wall 25 between a first frame position and a second frame position by means of an electric motor 39 arranged on cylindrical outer wall 25 and a gear rack transmission 41 co-acting therewith. In the first frame position shown in FIG. 2 closing guides 31, 33, and thereby the closing elements 35, 37 arranged therein, are positioned close to the end of the cylindrical outer wall 25 remote from cartridge chamber 23. In the second frame position shown in FIG. 3 frame 27 with closing guides 31, 33, and thereby the closing elements 35, 37 arranged therein, is translated relative to the first frame position away from passage 5 in the direction B of chamber 15 by means of electric motor 39 and gear rack transmission 41 co-acting therewith. Electric motor 39 is connected to the control which is arranged on printed circuit boards 9 and which is adapted to control electric motor 39.

The control is also connected to an electric motor 43 arranged on frame 27. Electric motor 43 is adapted with a transmission (not shown) co-acting therewith to translate closing elements arranged in closing guides 31, 33 along closing guides 31, 33.

The control is also connected to an infrared sensor 45 for detecting the presence of waste in the tubular film present in passage 5. This sensor 45 is arranged on printed circuit board 9*a*. Also arranged on printed circuit board 9*b* is a light source 47 which emits infrared radiation.

A through-hole 49 is situated in the cylindrical inner wall 29. In the first frame position as shown in FIG. 2 this hole 49 is situated at the level of infrared sensor 45 and light source 47 so that infrared radiation emitted by light source 47 radiates into passage 5. Waste that has been placed in passage 5 in the film present therein causes the radiation to be scattered. Infrared sensor 45 detects this scattering so that the control connected to sensor 45 can determine that waste has been placed in passage 5. The use of infrared makes it possible to determine the presence of waste, even in the case of tubular film (e.g. white polyethylene) which is non-transparent in visible light.

Once the presence of waste has been determined by the control, this latter will activate electric motor 11 of cover 3 such that cover 3 is carried from the opened state to the closed state, in which cover 3 closes passage 5. Once cover 3 has been moved into the closed state, the control will control electric motors 39 and 43 such that the portion of the tubular film present in passage 5 and the waste situated therein are transported from passage 5 to chamber 15. This process is described below with reference to FIGS. 4*a* to 4*e*.

Figure 4B:
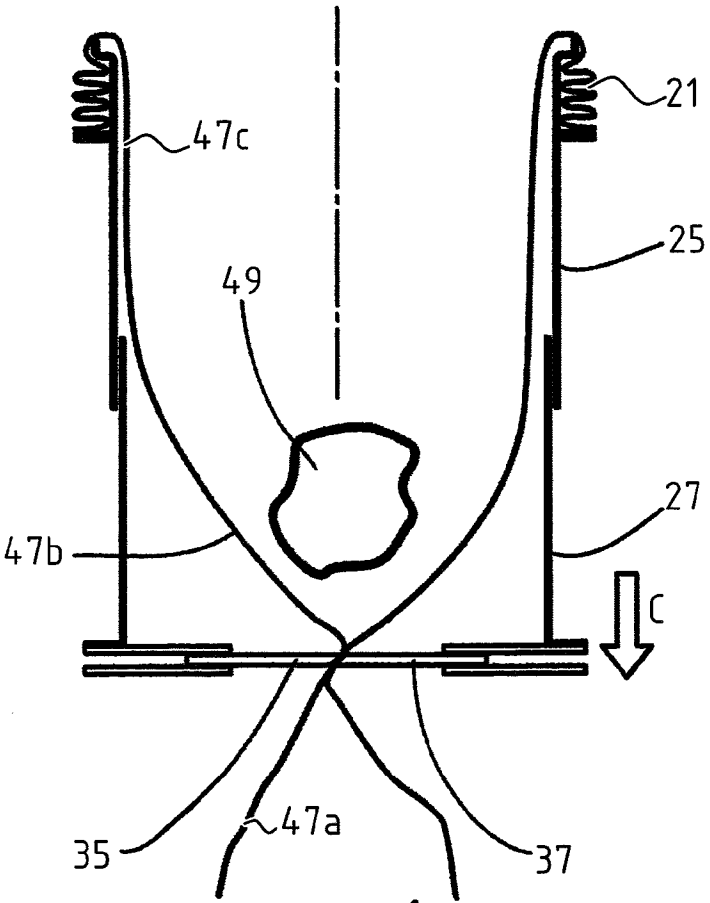
Figure 4A:
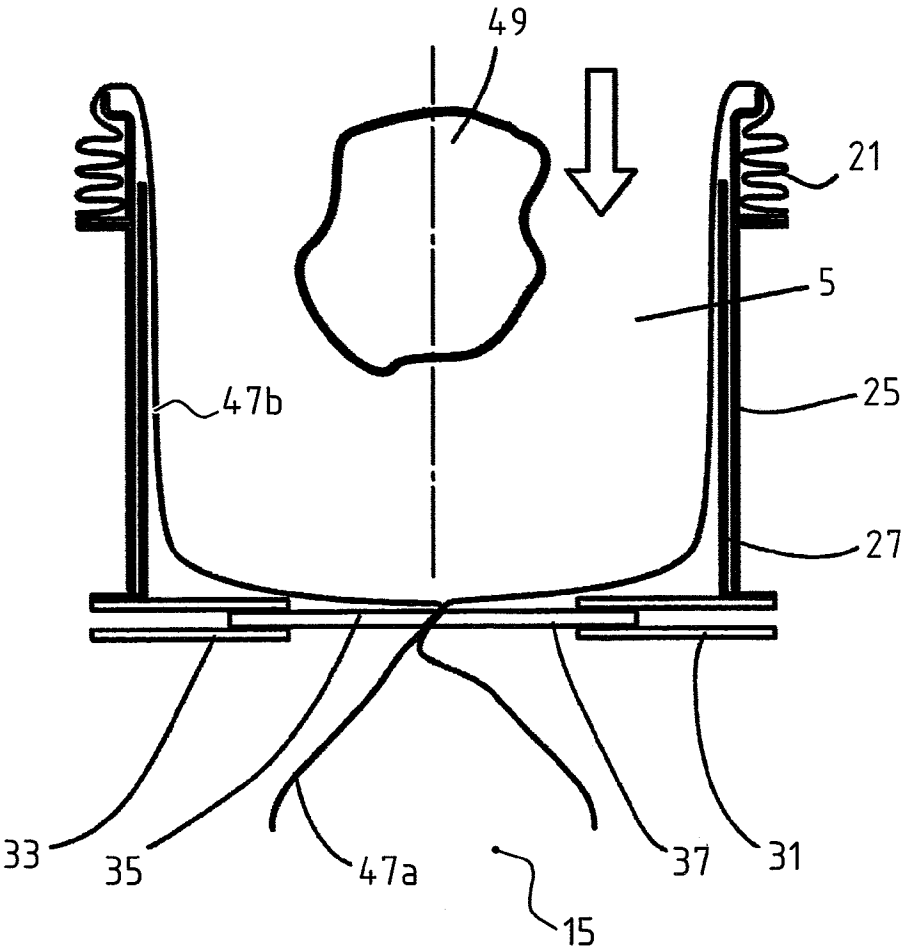

FIG. 4*a* shows that frame 27 is situated in the first frame position. Closing elements 35, 37 are arranged in closing guides 31, 33. Tubular film 47 is positioned between closing elements 35, 37. Tubular film 47 is guided by the cylindrical outer wall 25 forming passage 5 out of cartridge 21 with supply of tubular film 47 to chamber 15.

In FIG. 4*a* closing elements 35, 37 are in the closed state in which they press together the tubular film 47 positioned therebetween to form a sealing closure. Owing to this sealing closure odours from waste present in portion 47*a* of tubular film 47 already situated in chamber 15 cannot find their way outside device 1 via passage 5.

FIG. 4*a* shows that waste 49 is placed into the portion 47*b* of tubular film 47 situated in passage 5.

FIG. 4*b* shows that, once cover 3 has been carried from the opened state to the closed state, frame 27 is translated from the first frame position as shown in FIG. 4*a* away from passage 5 in the direction C of chamber 15 into the second frame position as shown in FIG. 4*b*. Closing elements 35, 37 are carried here from a first closing position, which in this embodiment is the same as the first frame position, in the closed state of closing elements 35, 37 to a second closing position, which in this embodiment is the same as the second frame position. Because during displacement of closing elements 35, 37 from the first closing position to the second closing position the closing elements remain in the closed state in which tubular film 47 is pressed together, the portion 47*b* of tubular film 47 in which waste 49 has been placed is transported in the direction of chamber 15 and a subsequent portion 47*c* is pulled out of cartridge 21 into passage 5.

Figure 4D:
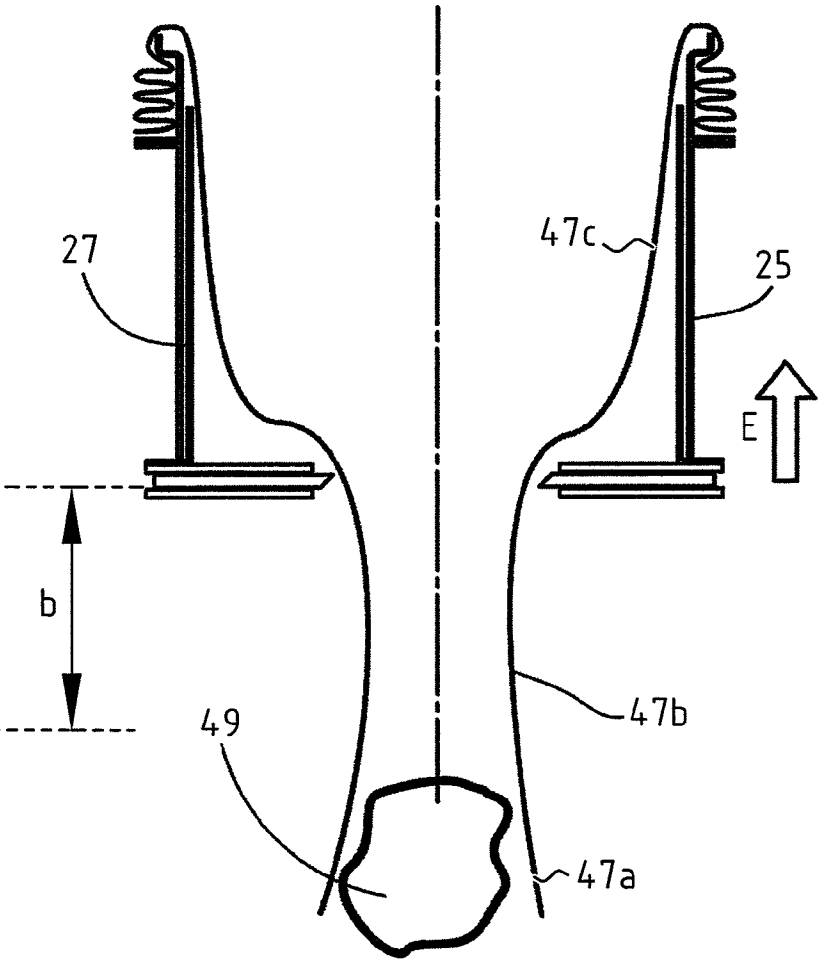
Figure 4C:
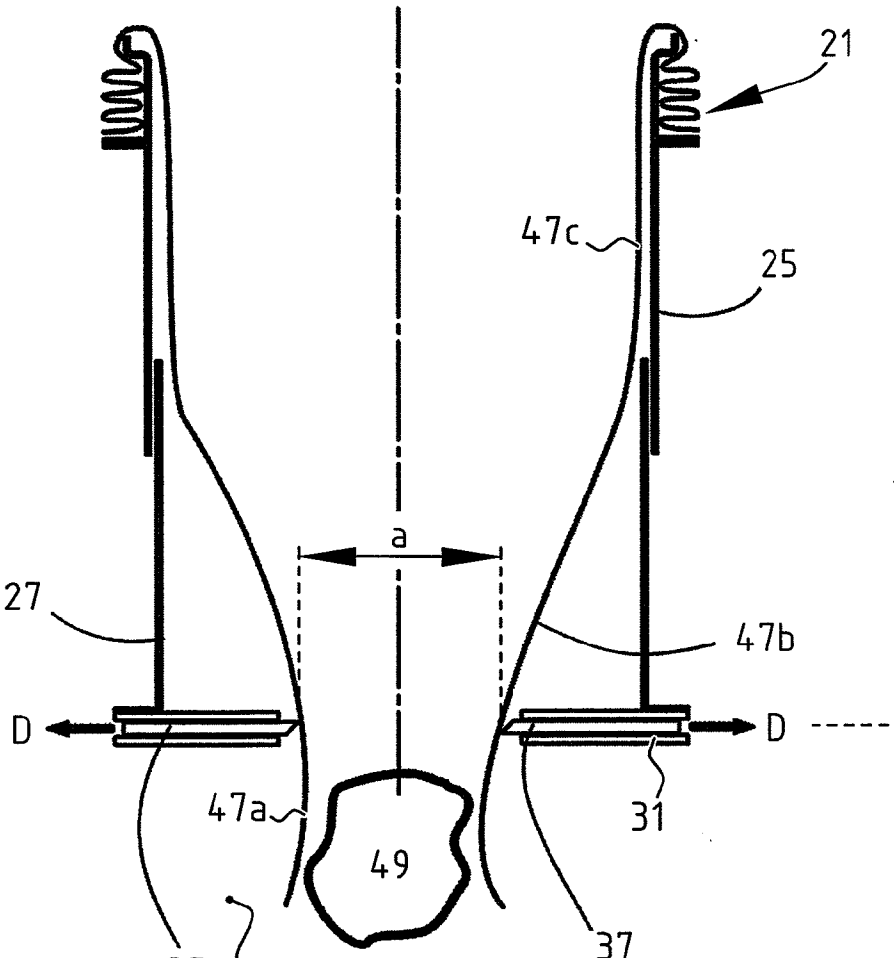

FIG. 4*c* shows that, in the second closing position of closing elements 35, 37, the closing elements 35, 37 are carried by means of a translation relative to frame 27 along closing guides 31, 33 in the direction of arrows D from the closed state to an open state. As shown in FIG. 4*c*, the closing elements are situated in the open state at a distance a from each other so that the sealing closure of the tubular film is released. As shown in FIG. 4*c*, the waste 49 can now drop into portion 47*a* of tubular film 47 which was already situated in chamber 15. Although the closing seal is released, odours from the portion 47*a* of tubular film 47 which was already situated in chamber 15 cannot find their way out of device 1 since cover 3 is closed. Nor can the user see the waste present in portion 47*a* of tubular film 47 already situated in chamber 15 because cover 3 is closed.

FIG. 4*d* shows that frame 27 and the closing elements 35, 37 arranged thereon are then translated, with these closing elements 35, 37 in the open state, from the second frame position/closing position in the direction E of passage 5 to the first frame position/closing position. Because closing elements 35, 37 are positioned at distance a from each other in the open state, closing elements 35, 37 pass the portion 47*b* of tubular film 47 during the translation.

Figure 4E:
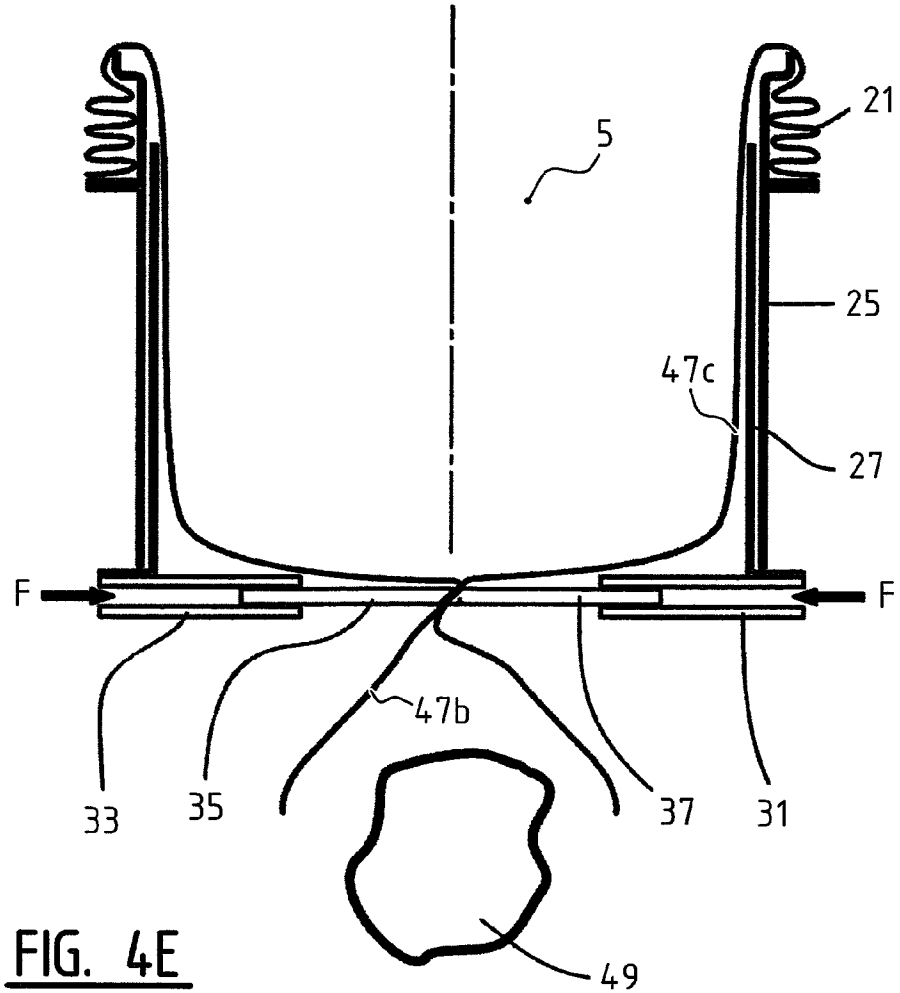

Shown in FIG. 4*e* is that closing elements 35, 37, back in the first closing position, are carried by means of a translation along closing guides 31, 33 from the open state in the direction of arrows F to the closed state. As shown in FIG. 4*e*, in the closed state the closing elements 35, 37 press the tubular film 47 together again into a sealing closure, just as in the earlier situation as shown in FIG. 4*a*. As described above, a subsequent user can open cover 3 of the device and place further waste in the portion 47*c* of tubular film 47 situated in passage 5. Because tubular film 47 has been pressed together to form a sealing closure and portion 47*c* of tubular film 47 present in passage 5 has not been in contact with waste previously placed in the device, the following user is not confronted with this previous waste. It is noted that in the shown embodiment the distance between the first closing position and the second closing position b is sufficiently large that all the portion 47*b* of tubular film 47 is transported into the chamber. The cycle shown in FIGS. 4*a* to 4*e* can be repeated until the supply of film in cartridge 21 is used up or until chamber 15 is completely filled with waste and tubular film.

FIG. 5 shows an alternative embodiment of device 1 as shown in FIGS. 1 to 4.

Device 101 shown in FIG. 5 is the same as device 1 of FIGS. 1 to 4, with the exception of the closing and transport mechanism which enables the process of closing and transporting the tubular film as shown in FIGS. 4*a* to 4*e*. The same components and components having the same function are designated where possible with the same reference numeral, be it that 100 is added to the reference numeral.

In contrast to the situation as shown in FIG. 1, cover 103 is in the closed state in the situation as shown in FIG. 5.

The components shown in FIG. 5 with broken lines are shown in FIGS. 6*a* to 6*e* in order to show for device 101 the process of closing and transporting the tubular film as shown in FIGS. 4*a* to 4*e*.

Figure 6A:
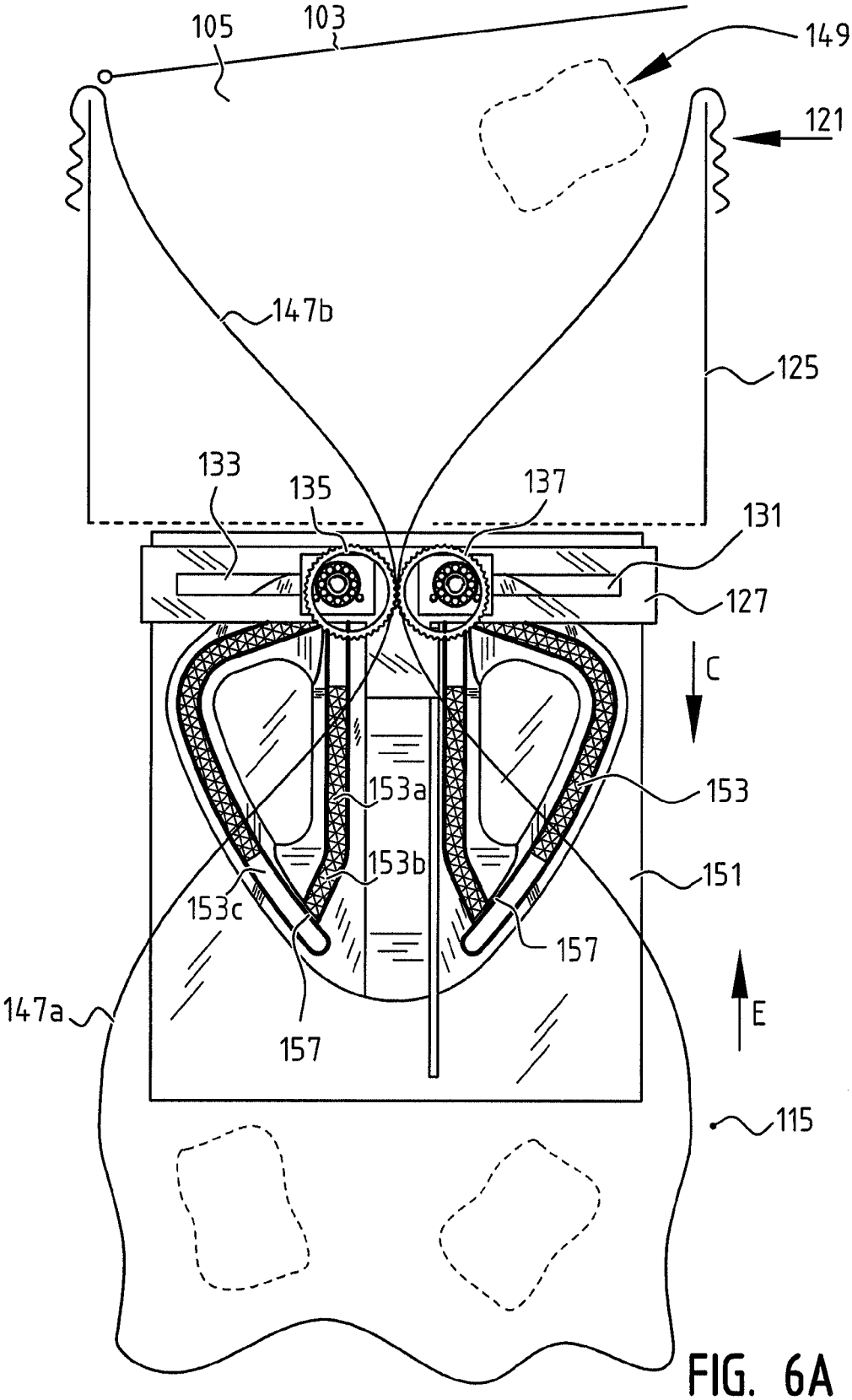

FIG. 6*a* shows that a guide plate 151 is disposed stationary relative to passage 105 in device 101. This guide plate 151 forms a frame guide for a frame 127 along which frame 127 can be translated from the first frame position shown in FIG. 6*a* away from passage 105 in the direction F of chamber 115 to a second frame position. Frame 127 is shown with slot-like closing guides 131, 133 in which closing elements 135, 137 are arranged for translation relative to frame 127. These closing elements 135, 137 are further shown in FIG. 7.

Arranged in the guide plate is a slot-like coupling guide 153 in which closing elements 135, 137 are also arranged. This coupling guide 153 defines a path along which closing elements 135, 137 are guided during translation of frame 127 along guide plate 151 from the first frame position away from passage 105 in the direction C of chamber 115 into a second frame position, and from the second frame position away from chamber 115 in the direction E of passage 105 into the first frame position. The translation of closing elements 135, 137 along closing guides 131, 133 and the translation of frame 127 along guide plate 151 are thus coupled.

FIG. 6*a* shows that frame 127 is situated in the first frame position. This first frame position is also the first closing position of closing elements 135, 137 in which closing elements 135, 137 are in the closed state. As shown, in the closed state the closing elements 135, 137 press the tubular film 147 positioned therebetween together to form a sealing closure.

Shown in FIG. 6*a* is that waste 149 is introduced into the portion 147*b* of tubular film 147 situated in passage 105 after cover 103 has been moved into the opened state.

Figure 6B:
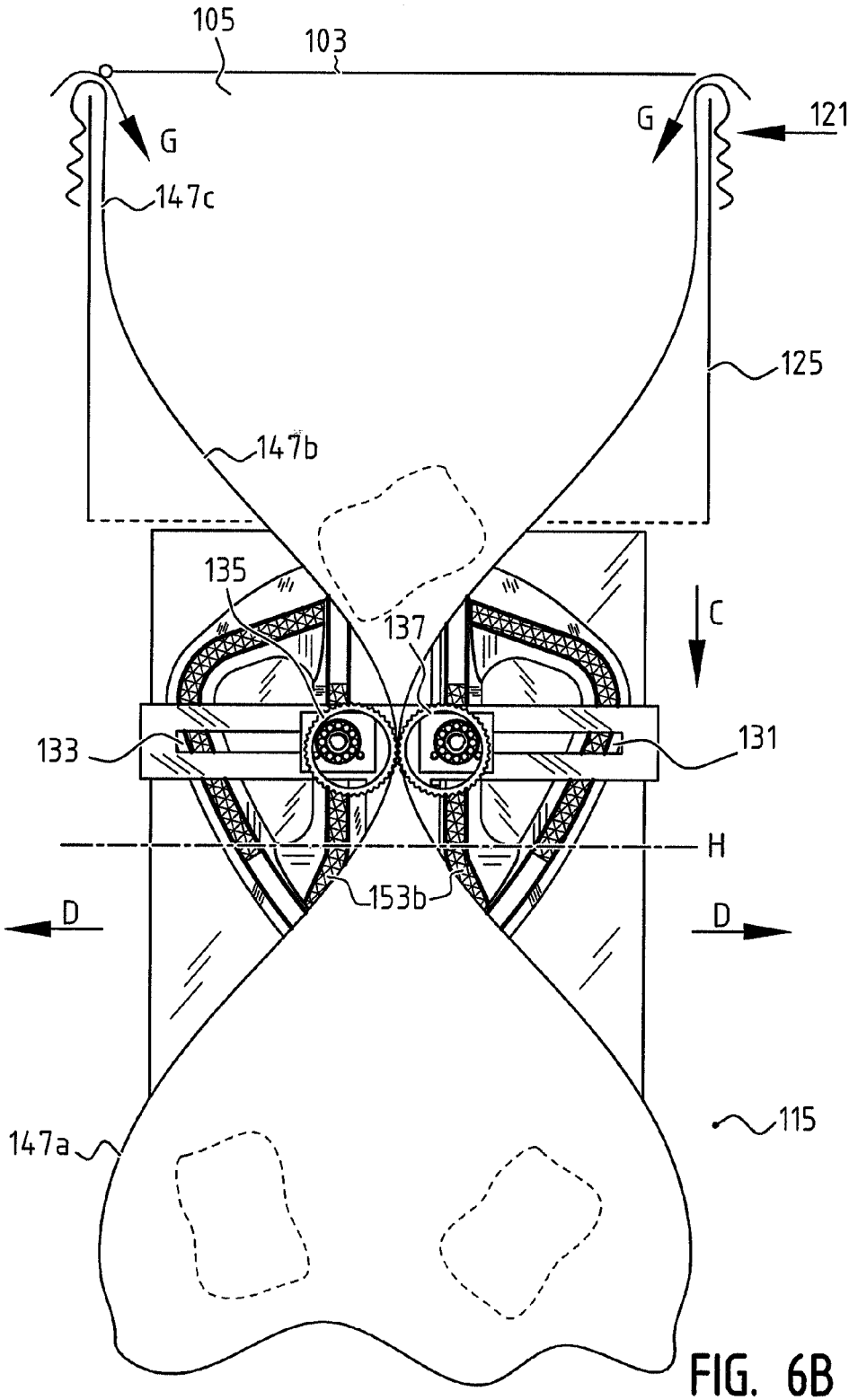
Figure 6C:
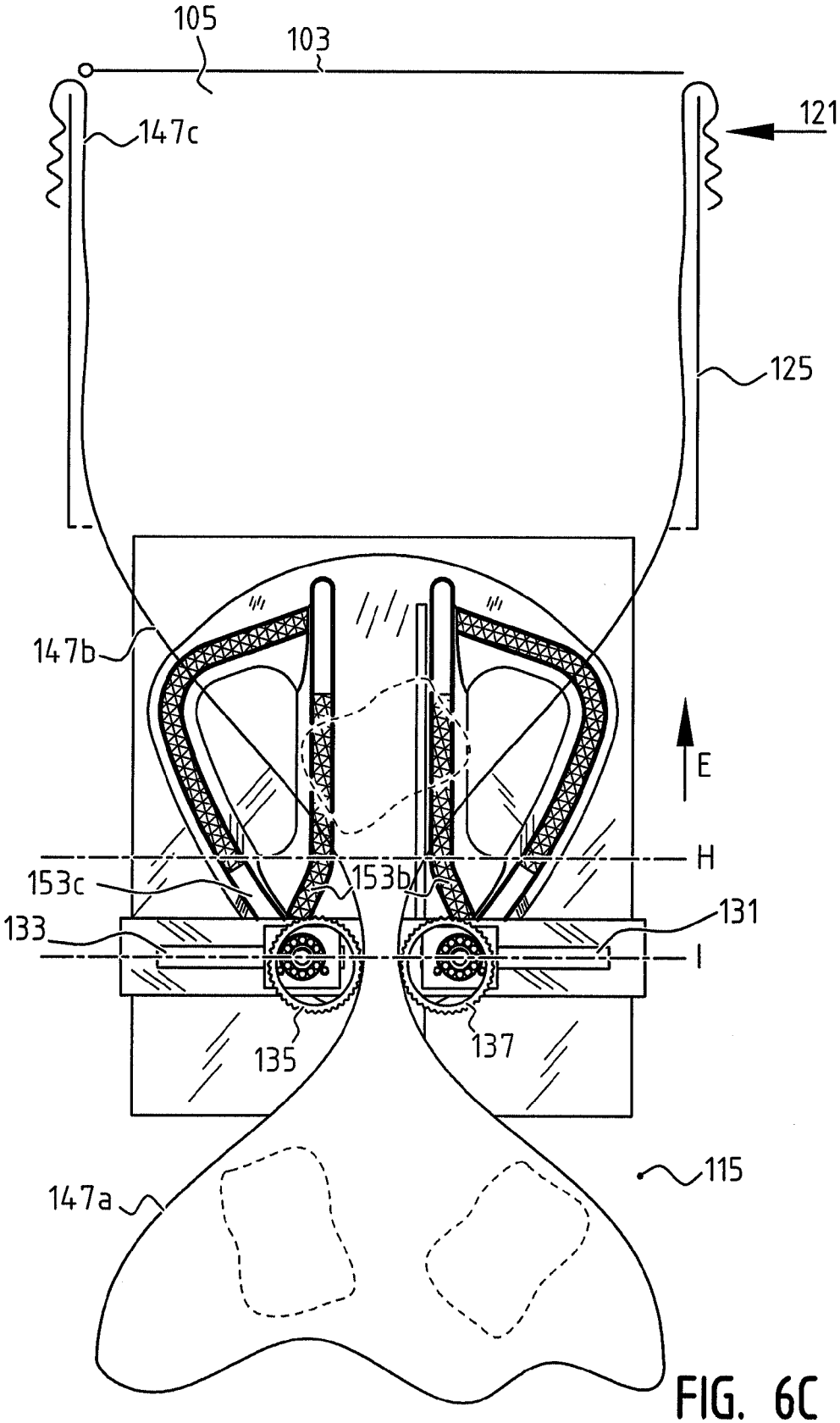

FIG. 6*b* shows that, after cover 103 has been moved from the opened state to the closed state, frame 27 is translated from the first frame position as shown in FIG. 6*a* away from passage 105 in the direction C of chamber 115. Closing elements 135, 137 herein follow the portion 153*a* of coupling guide 153 so that closing elements 135, 137 in the closed state of closing elements 135, 137 are here also translated from the first closing position in the direction C of chamber 115. Because during the displacement of closing elements 135, 137 the closing elements remain in the closed state in which tubular film 147 is pressed together, the portion 147*b* of tubular film 147 in which the waste 149 has been placed is transported in the direction of chamber 115, and a subsequent portion 147*c* is pulled out of cartridge 21 into passage 105 as according to arrows G. As soon as closing elements 135, 137 reach the position H in coupling guide 153, closing elements 135, 137 are situated in the second closing position. Translation of frame 127 in the direction C of chamber 105 is however not stopped in the second closing position, so that closing elements 135, 137 are guided along portion 153*b* of coupling guide 153. Closing elements 135, 137 are translated here away from each other in the direction D relative to frame 127 along closing guides 131, 133 so that closing elements 135, 137 are carried into the open position. Guide elements 135, 137 thus enter the portion 153*c* of coupling guide 153 after passing a non-return valve 157. Frame 127 is then situated in the second frame position I as shown in FIG. 6*c*.

Figure 6D:
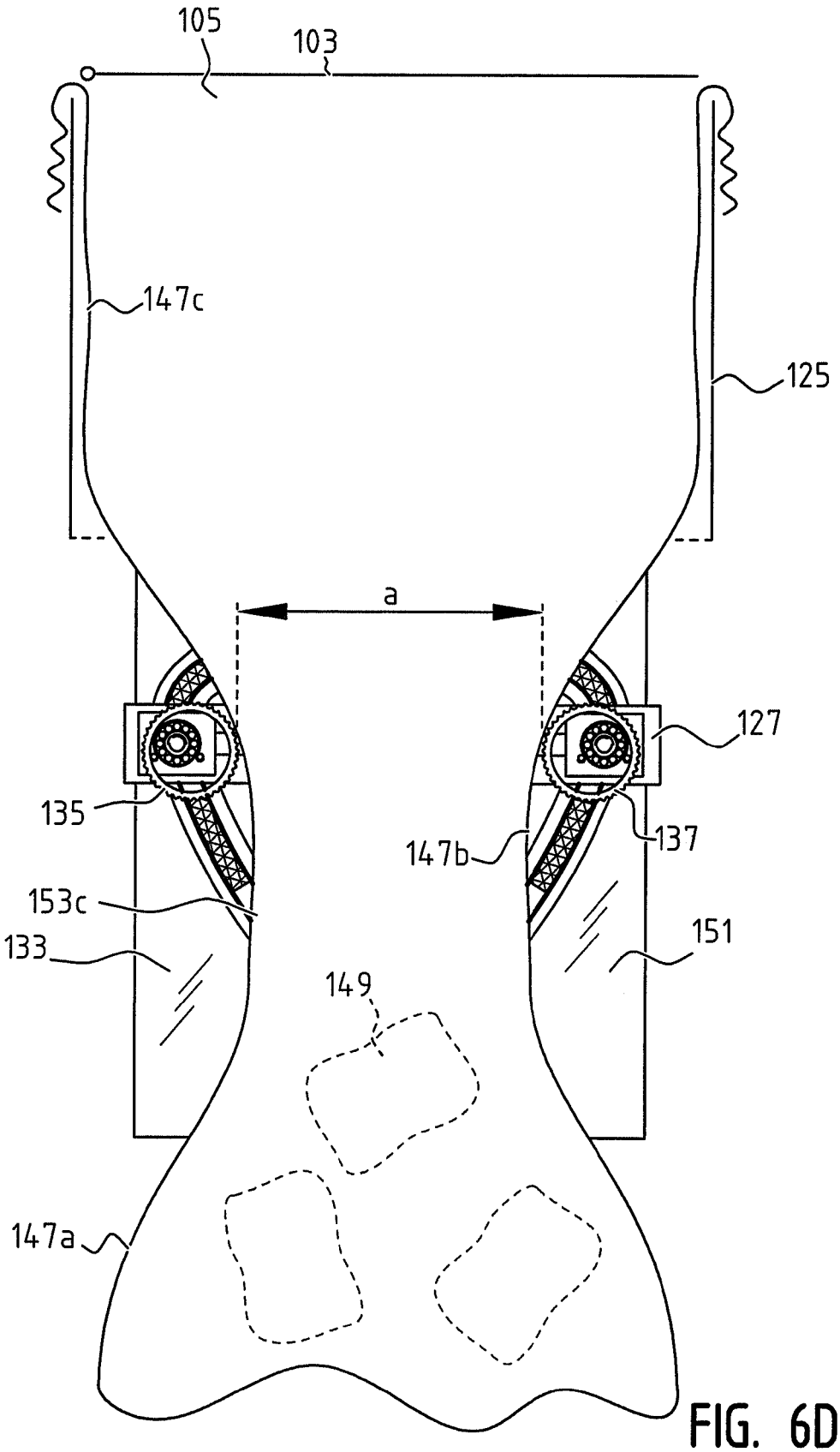
Figure 6E:
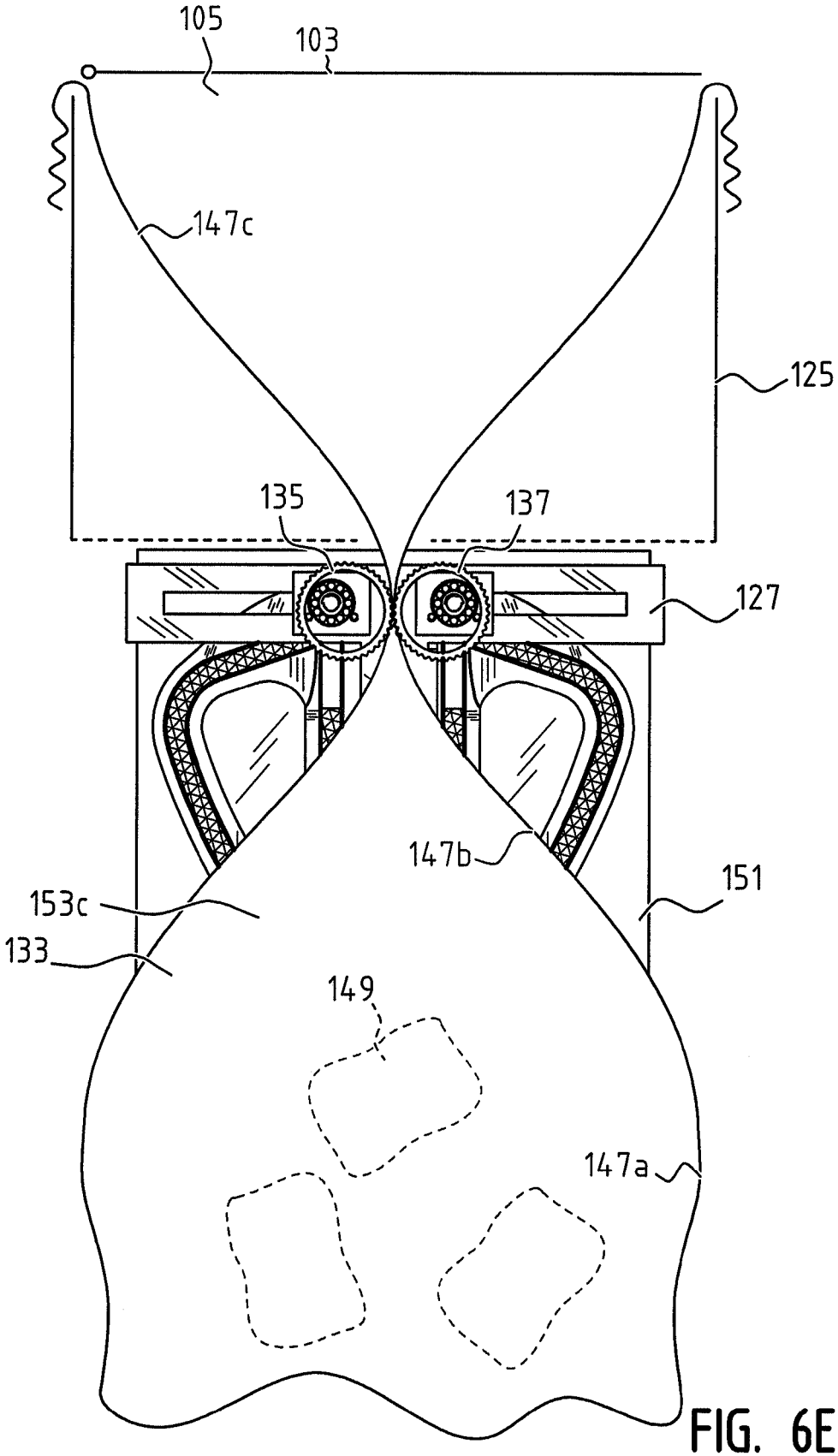

From the second frame position I frame 127 is then translated along guide plate 151 in the direction E of passage 105. Because non-return valve 157 prevents the closing elements 135, 137 following the portions 153*a* and 153*b* of coupling guide 153 which have already been followed, they follow the portion 153*c* of coupling guide 153, wherein as shown in FIGS. 6*c*, 6*d* and 6*e* the distance a between closing elements 135, 137 is first increased and subsequently reduced. After passing a second non-return valve 159, closing elements 135, 137 thus arrive once again at the first closing position as shown in FIG. 6*e*, in which the closing elements 135, 137 are in the closed state. Just as in the situation shown in FIG. 4*e*, a subsequent user can, as described above, open cover 103 of the device and place subsequent waste in portion 147*c* of tubular film 147 present in passage 5.

FIG. 7 shows that closing elements 135, 137 each comprise a roller 165, 167 which can be rotated about an eccentrically placed rotation shaft 161, 163 and which is biased by means of a spring 169, 171 in the direction E, this direction being opposite to the direction C in which closing elements 135, 137 are moved from the first closing position to the second closing position.

FIG. 8 shows that for the purpose of translating frame 127 relative to guide plate 151, and thereby relative to passage 105, there is provided an electric motor 139 arranged on frame 127 and gear rack transmission 141 co-acting therewith. This electric motor is connected to the control as described for electric motor 39 of device 1 of FIGS. 1 to 4.

FIG. 9 shows an alternative embodiment of device 101 as shown in FIGS. 5 to 8.

Device 201 shown in FIG. 9 is the same as device 101 of FIGS. 5 to 8 except for the drive of the closing and transport mechanism enabling the process of closing and transporting the tubular film as shown in FIGS. 6*a* to 6*e*. The same components and components having the same function are designated where possible with the same reference numeral, be it that 100 is added to the reference numeral.

The embodiment shown in FIG. 9 does not comprise any electronic elements for driving of the closing and transport mechanism. Device 201 is operated by the user by means of an operating element in the form of a foot pedal 273.

The driving by means of pedal 273 is shown schematically in FIG. 10. In FIG. 10 pedal 273 is situated in a first operating position. A user can displace the pedal by means of foot force from the first operating position in the direction of arrow J to a second operating position.

As shown in FIGS. 9 and 10, pedal 273 and cover 103 are connected by means of a coupling mechanism in the form of coupling rods 275, 277 and a connecting plate 278 which are connected pivotally to each other. When the operating element is displaced from the first operating position to the second operating position in the direction of arrow J, coupling rod 275 rotates around the rotation axis 279 thereof, with the result that coupling rod 277 is displaced in the direction of arrow K. Cover 203 is carried from the closed state to the opened state by the displacement of coupling rod 277 in the direction of arrow K. During the displacement of coupling rod 277 in the direction of arrow K by means of gear rack transmission 281*a* spring system 283 is also driven so that the displacement of pedal 273 is stored in the form of spring energy in spring system 283. Spring 285 is also extended during the displacement of coupling rod 277 in the direction of arrow K.

As soon as the user release pedal 273 after placing waste in passage 205, coupling rod 277 is displaced by means of spring 285 in the direction of arrow L. Cover 203 is carried here from the opened state to the closed state and coupling rod 275 rotates around rotation axis 279 thereof, with the result that pedal 273 is returned from the second operating position to the first operating position in the direction of arrow M. During the displacement of coupling rod 277 in the direction of arrow L by means of the gear rack transmission 281 spring system 283 is also driven so that the displacement of pedal 273 is once again stored in the form of spring energy in spring system 283.

As soon as pedal 273 has been returned to the first operating position and the cover is thus in the closed state, the spring energy stored in spring system 283 is converted by means of a transmission 274 into the translation of frame 217 from the first frame position to the second frame position, and subsequently from the second frame position to the first frame position as shown in FIGS. 6*a* to 6*e*.

In the first embodiment as shown in FIGS. 1 to 4 and the second embodiment as shown in FIGS. 6 to 8 the device comes into operation as soon as it is determined that the cover is closed and waste is present in the passage. It is however also possible that such a device not be provided with a sensor for detecting waste in the passage. The control can in that case be adapted to close the cover after for instance a determined period of time after opening of the cover, or for instance after the user has indicated that the cover must be closed. It is also possible that a device, such as the first and second embodiments, is not adapted to actively open and close the cover. In such an embodiment the user him/herself must open and close the cover and the device must be provided with a sensor for detecting that the cover has been carried from the opened state to the closed state. The user can open the cover him/herself by means of for instance a pedal as applied in the third embodiment of FIGS. 9 and 10.

A variant of the embodiments as shown in figures could be that electrical energy is generated by means of a generator during displacement of a pedal between the operating positions thereof, and that the energy generated is used to provide the electric motor or electric motors with energy.

In the three shown exemplary embodiments both closing elements can in each case be displaced relative to the frame. Alternatively, one of the two closing elements is displaced relative to the frame and the other is arranged stationary on the frame. In such a case the displaceable closing element can be deemed a jaw and the other closing element a stop.

The invention claimed is:

1. A device for storing waste, which device is adapted to receive a supply of tubular film and comprises a chamber for receiving waste deposited in the tubular film, wherein the device comprises:

a passage adapted to guide the tubular film from the supply to the chamber;

a cover which in an open state gives access to the passage for the purpose of placing waste in the tubular film guided by the passage, and which in a closed state closes the passage;

a first and a second closing element on a side of the passage remote from the cover, between which closing elements the tubular film can be positioned;

a closing and transport mechanism adapted to carry the closing elements in a closed state from a first closing position away from the passage in the direction of the chamber to a second closing position, and to carry the closing elements in an open state from the second closing position back to the first closing position, wherein back in the first closing position the closing elements are back in the closed state, wherein in the closed state the closing elements press together the tubular film positioned therebetween to form a sealing closure, and wherein in the open state the closing elements are situated at a distance from each other so that the sealing closure is released and the closing elements can be displaced along the tubular film and waste deposited therein, wherein the closing and transport mechanism comprises:

at least one electric motor and a transmission co-acting therewith which are adapted to drive the closing and transport mechanism; and a control which is connected to the at least one electric motor and adapted to control the at least one electric motor, wherein the control is also adapted to determine that the cover has been moved from the opened state to the closed state thereof and, after determining that the cover has been moved from the opened state to the closed state thereof, to activate the at least one electric motor;

wherein the device is adapted to set the closing and transport mechanism into operation once the cover has been moved from the opened state to the closed state thereof; and wherein the device comprises:

a sensor which is connected to the control and with which the control can determine that a user wishes to use the device;

an electric motor connected to the control and transmission co-acting therewith with which the cover can be carried from the closed state to the open state and from the open state to the closed state;

wherein the control is adapted, after determining that a user wishes to use the device, to control the electric motor of the cover such that the cover is carried from the closed state to the opened state and, after a determined period of time or after determining that the user has placed waste in tubular film, to control the electric motor of the cover such that the cover is carried from the opened state to the closed state, and to subsequently activate the at least one electric motor of the closing and transport mechanism.

2. The device as claimed in claim 1, wherein the device comprises a sensor which is connected to the control and using which the control can determine whether the cover is in the opened state or the closed state.

3. The device as claimed in claim 1, wherein both closing elements are translated relative to the frame when the closing elements are carried from the open state to the closed state, and when the closing elements are carried from the closed state to the open state.

4. The device as claimed in claim 1, wherein—at least one of the closing elements comprises resilient material for pressing together the tubular film in sealing manner.

5. The device as claimed in claim 1, wherein at least one of the closing elements comprises a roller which can be rotated about an eccentric rotation axis and which is biased in a starting position by means of a spring, wherein the roller is arranged such that, when the roller is pressed against the relevant closing element in order to carry the closing elements into the closed state, the roller is pressed out of the starting position and rotated about the rotation axis counter to the action of the spring; and wherein the roller is arranged such that the spring biases the roller in a direction opposite to the direction in which the closing elements are moved from the first closing position to the second closing position.

6. The device as claimed in claim 1, wherein the device comprises between the closing elements and the cover a sensor connected to the control for detecting the presence of waste in the passage; and the control is adapted to activate the at least one electric motor of the closing and transport mechanism once the presence of waste in the passage has been detected.

7. The device as claimed in claim 6, wherein the sensor for detecting the presence of waste in the passage is an infrared sensor.

8. The device as claimed in claim 1, wherein the closing and transport mechanism comprises a frame arranged translatably in the device by means of transport guide so that the frame can be translated along the frame guide from a first frame position away from the passage in the direction of the chamber into a second frame position, and can be translated from the second frame position away from the chamber in the direction of the passage into the first frame position;

wherein the closing elements are arranged on the frame;

at least one of the closing elements is arranged on the frame for translation relative to the frame by means of a closing guide so that, by means of a translation along the closing guide, from the open state the closing elements can be moved toward each other in order to carry the closing elements into the closed state and from the closed state can be moved away from each other in order to carry the closing elements into the open state;

the closing and transport mechanism comprises a coupling guide which defines a path along which the relevant closing element which is arranged translatably on the frame by means of the closing guide is guided during the translation of the frame along the frame guide from the first frame position away from the passage in the direction of the chamber into a second frame position, and from the second frame position away from the chamber in the direction of the passage into the first frame position, so that the translation of the relevant closing element along the closing guide and the translation of the frame along the frame guide are coupled;

the device comprises an operating element which can be displaced by a user from a first operating position to a second operating position;

the operating element and the cover are connected by means of a coupling mechanism so that during the displacement of the operating element from the first operating position to the second operating position the cover is carried from the closed state to the opened state, and during the displacement of the operating element from the second operating position to the first operating position the cover is carried from the opened state to the closed state;

the operating element and the closing and transport mechanism are coupled by means of an energy storage mechanism; wherein the energy storage mechanism comprises:

a generator which is adapted during displacement of the operating element to generate energy from this displacement and to store this energy; and a motor and transmission co-acting therewith which are adapted to use the stored energy to translate the frame from the first frame position to the second frame position and subsequently from the second frame position to the first frame position;

and wherein the energy storage mechanism is adapted to activate the motor after the operating element has been displaced from the second operating position to the first operating position.

9. The device as claimed in claim 8, wherein the generator comprises a spring system coupled by means of a transmission to the operating element so that a displacement of the operating element is stored in the form of spring energy;

the motor is adapted to convert the stored spring energy to a movement which can be transmitted by means of the transmission co-acting with the motor to the frame in order to translate the frame along the frame guide.

10. The device claimed in claim 1, wherein the closing and transport mechanism comprises:

a frame arranged translatably in the device by means of a transport guide so that the frame can be translated along the frame guide from a first frame position away from the passage in the direction of the chamber into a second frame position, and can be translated from the second frame position away from the chamber in the direction of the passage into the first frame position;

wherein the closing elements are arranged on the frame;

at least one of the closing elements is arranged on the frame for translation relative to the frame by means of a closing guide so that, by means of a translation along the closing guide, from the open state the closing elements can be moved toward each other in order to carry the closing elements into the closed state and from the closed state can be moved away from each other in order to carry the closing elements into the open state.

11. The device as claimed in claim 10, wherein the closing and transport mechanism comprises:

a coupling guide which defines a path along which the closing element which is arranged translatably on the frame by means of the closing guide is guided during the translation of the frame along the frame guide from the first frame position away from the passage in the direction of the chamber into a second frame position, and from the second frame position away from the chamber in the direction of the passage into the first frame position, so that the translation of the relevant closing element along the closing guide and the translation of the frame along the frame guide are coupled;

wherein an electric motor and a transmission co-acting therewith are adapted to translate the frame along the frame guide;

the control is adapted to control the electric motor upon activation thereof such that the frame is translated along the frame guide from the first frame position away from the passage in the direction of the chamber into a second frame position, and is subsequently translated from the second frame position away from the chamber in the direction of the passage into the first frame position; and the coupling guide is adapted such that, during translation of the frame by means of the electric motor, the closing elements in the closed state are carried from the first closing position away from the passage in the direction of the chamber to the second closing position, and from the second closing position the closing elements are carried in the open state back to the first closing position, wherein back in the first closing position the closing elements are back in the closed state.

12. The device as claimed as claimed in claim 10, wherein a first electric motor and a transmission co-acting therewith are adapted to translate the frame along the transport guide;

a second electric motor and a transmission co-acting therewith are adapted to translate the relevant closing element along the closing guide; and the control is adapted to control the first electric motor and the second electric motor such that the closing elements in a closed state are carried from a first closing position away from the passage in the direction of the chamber to a second closing position and the closing elements in an open state are carried from the second closing position back to the first closing position, wherein back in the first closing position the closing elements are back in the closed state.

* * * * *